US010322488B2

(12) United States Patent
Okada et al.

(10) Patent No.: US 10,322,488 B2
(45) Date of Patent: Jun. 18, 2019

(54) ROTATING TOOL, AND POLISHING TOOL

(71) Applicants: XEBEC TECHNOLOGY CO., LTD., Tokyo (JP); TAIMEI CHEMICALS CO., LTD., Nagano (JP)

(72) Inventors: Hiroyuki Okada, Tokyo (JP); Suguru Matsushita, Nagano (JP)

(73) Assignees: TAIMEI CHEMICALS CO., LTD., Nagano (JP); XEBEC TECHNOLOGY CO., LTD., Tokyo (JP)

( * ) Notice: Subject to any disclaimer, the term of this patent is extended or adjusted under 35 U.S.C. 154(b) by 288 days.

(21) Appl. No.: 15/305,645

(22) PCT Filed: Feb. 3, 2015

(86) PCT No.: PCT/JP2015/053014
§ 371 (c)(1),
(2) Date: Oct. 20, 2016

(87) PCT Pub. No.: WO2015/166679
PCT Pub. Date: Nov. 5, 2015

(65) Prior Publication Data

US 2017/0043444 A1 Feb. 16, 2017

(30) Foreign Application Priority Data

May 1, 2014 (JP) ..... 2014-094742

(51) Int. Cl.
*B24B 5/40* (2006.01)
*B24B 29/00* (2006.01)
(Continued)

(52) U.S. Cl.
CPC ..... *B24B 5/40* (2013.01); *B24B 7/10* (2013.01); *B24B 23/08* (2013.01); *B24B 29/00* (2013.01);
(Continued)

(58) Field of Classification Search
CPC .... B24B 5/06; B24B 5/08; B24B 5/10; B24B 5/40; B24B 29/005; B24B 29/02; B24D 13/14; B24D 13/145
See application file for complete search history.

(56) References Cited

U.S. PATENT DOCUMENTS 2,608,034 A * 8/1952 Fromson ..... B24D 13/10 15/169
2,657,506 A * 11/1953 Hadley ..... B08B 9/0553 15/104.061
(Continued)

FOREIGN PATENT DOCUMENTS

CN 1615208 A 5/2005
EP 1543924 A1 6/2005
(Continued)

OTHER PUBLICATIONS

World Intellectual Property Organization, International Search Report for PCT International Patent Application No. PCT/JP2015/053014, dated Mar. 10, 2015.
(Continued)

*Primary Examiner* — Timothy V Eley

(57) ABSTRACT

A rotating tool includes a tool body including a polishing tool and a shank, and a flange part provided in the tool body. The polishing tool includes a plurality of linear grinding members and a grinding member holder to hold the linear grinding members. The flange part is an annular member, and attached to the grinding member holder, so as to be movable in the direction of an axial line and rotatable about the axial line. When the inner circumferential surface of a hole formed in a workpiece is processed, the grinding member holder and the annular member are inserted into the hole. When run-out on the front side of the rotating tool
(Continued)

occurs, the annular member comes into contact with the peripheral wall surface of the hole, whereby the run-out of the tool body is reduced.

11 Claims, 24 Drawing Sheets

(51) Int. Cl.

| | |
|---|---|
| ***B24D 13/14*** | (2006.01) |
| ***B24B 23/08*** | (2006.01) |
| ***B24D 13/20*** | (2006.01) |
| ***B24B 7/10*** | (2006.01) |

(52) U.S. Cl.
CPC ..... *B24B 29/005* (2013.01); *B24D 13/14* (2013.01); *B24D 13/145* (2013.01); *B24D 13/20* (2013.01)

(56) References Cited

U.S. PATENT DOCUMENTS

| | | | | |
|---|---|---|---|---|
| 3,383,727 | A * | 5/1968 | Hanson | H01M 2/30 15/104.04 |
| 3,587,194 | A * | 6/1971 | Brown | B24B 5/40 15/104.12 |
| 3,696,563 | A * | 10/1972 | Rands | B24D 13/10 15/197 |
| 3,882,640 | A * | 5/1975 | Watt | B24B 5/40 409/175 |
| 5,899,795 | A | 5/1999 | Penza | |
| 7,434,289 | B2 * | 10/2008 | Sumiyoshi | A46B 13/008 15/179 |
| 8,123,441 | B2 * | 2/2012 | Pieri | B23B 27/06 408/1 R |
| 2007/0161339 | A1 * | 7/2007 | Wentworth | B24B 5/40 451/51 |
| 2016/0016293 | A1 * | 1/2016 | Matsushita | A46D 1/00 451/532 |
| 2017/0036323 | A1 * | 2/2017 | Sato | B24B 29/00 |

FOREIGN PATENT DOCUMENTS

| | | | |
|---|---|---|---|
| JP | S57-38381 | A | 8/1982 |
| JP | H03-7453 | U | 1/1991 |
| JP | H03-017497 | U | 2/1991 |
| JP | H06-31603 | A | 2/1994 |
| JP | 2001-138251 | A | 5/2001 |
| JP | 2004/009293 | A | 1/2004 |
| JP | 2004-202671 | A | 7/2004 |
| JP | 2009-050967 | A | 3/2009 |

OTHER PUBLICATIONS

World Intellectual Property Organization, Written Opinion for PCT International Patent Application No. PCT/JP2015/053014, dated Mar. 10, 2015.

Japan Patent Office, Office Action for Japanese Patent Application No. 2016-515868, dated Nov. 6, 2018.

The State Intellectual Property Office of People's Republic of China, Search Report for Chinese Patent Application No. 2015800227018, dated Mar. 14, 2018 (It should be noted that all the listed documents in the Original CN Search Report are listed in the English version of the Search Report but the order of the references listed in the English version is not same as that of the original CN Search Report).

* cited by examiner

ROTATING TOOL, AND POLISHING TOOL

FIELD

The present invention relates to a rotating tool configured to process the inner circumferential surface of a hole formed in a workpiece, and relates to a polishing tool included in the rotating tool. Furthermore, the present invention relates to a processing method of processing the inner circumferential surface of a hole formed in a workpiece with the rotating tool.

BACKGROUND

When a tool is inserted into a hole formed in a workpiece to polish the inner circumferential surface of the hole or to deburr the edge of another hole intersecting with the above-mentioned hole, a rotating tool including grinding members at the front end thereof is employed. Patent Literature 1 describes a rotating tool including a plurality of linear grinding members, a grinding member holder to bundle the rear ends of the plurality of linear grinding members, and a shank extending backward coaxially from the grinding member holder.

CITATION LIST

Patent Literature

Patent Literature 1: Japanese Unexamined Patent Application Publication No. 2007-75954 (JP 2007-75954 A)

SUMMARY

Technical Problem

When the bottom of a hole formed in a workpiece is polished, a rotating tool needs to include a shank having a length corresponding to the depth of the hole so as to bring the front ends of grinding members into contact with the bottom of the hole. However, in the case where the shank has a longer length, when the rotating tool attached to a machine tool is rotationally driven, large run-outs can easily occur on the front side of the rotating tool due to centrifugal force. Here, when a run-out occurs in the rotating tool, the position of the polishing tool including a grinding member and a grinding member holder becomes unstable, and accordingly, the accuracy of processing is lowered. Furthermore, there is a possibility that the run-out polishing tool comes into contact with a workpiece, thereby damaging the workpiece. Furthermore, there is a possibility that the run-out causes the shank to be badly bent or broken.

In view of these problems, an object of the present invention is to provide a rotating tool capable of controlling the run-out caused by centrifugal force when the inner circumferential surface of a hole formed in a workpiece is processed. Furthermore, an object of the present invention is to provide a polishing tool included in the rotating tool. Furthermore, an object of the present invention is to provide a processing method of processing the inner circumferential surface of a hole formed in a workpiece while controlling the run-out of the rotating tool.

Solution to Problem

To solve the problems, the present invention relates to a rotating tool configured to be inserted into a hole having a certain depth formed in a workpiece so as to process an inner circumferential surface of the hole, the rotating tool including: a tool body; and a spacer to maintain a certain spacing between a rotation center axial line of the tool body and a peripheral wall surface of the hole, in which the tool body includes a grinding member, a grinding member holder to hold a rear end of the grinding member, and a shank extending backward coaxially from the grinding member holder.

According to the present invention, when the inner circumferential surface of a hole formed in a workpiece is processed, a certain spacing between the rotation center axial line of the rotating tool and the peripheral wall surface of the hole is maintained by the spacer. With this configuration, the run-out range of the tool body is regulated, whereby a decrease in the accuracy of processing is reduced. Furthermore, since the run-out of the tool body is reduced, a workpiece can be prevented from being damaged by a contact of the workpiece with the grinding member holder or the shank. Furthermore, the shank can be prevented from being bent or broken due to the run-out.

In the present invention, the spacer may be integrally formed with the tool body, or may be detachably attached to the tool body. With this configuration, in the case where a run-out of the tool body occurs due to the rotation thereof, the spacer comes into contact with the peripheral wall surface of the hole, whereby the run-out range of the tool body can be regulated.

In the present invention, the spacer is preferably attached to the tool body in a state of being movable in a direction of the rotation center axial line. With this configuration, when the spacer comes into contact with the peripheral wall surface of the hole, the spacer moves independently of the tool body, and thus, the movement of the tool body in the forward and backward directions can be prevented from being inhibited.

In the present invention, the spacer is preferably attached to the tool body in a state of being rotatable about the rotation center axial line. With this configuration, when the spacer comes into contact with the peripheral wall surface of the hole, the spacer moves independently of the tool body, and thus, the rotation of the tool body can be prevented from being inhibited.

In the present invention, the spacer may include a fixed part to be fixed to the peripheral wall surface of the hole, and the tool body may penetrate the spacer in a freely rotatable state. That is, the spacer may not be attached to the tool body. In this case, for example, the spacer having a center hole is inserted into a hole of a workpiece and fixed to the peripheral wall surface of the hole. Thereafter, the tool body is made to penetrate the center hole of the spacer and rotate, whereby the inner circumferential surface of the hole can be processed.

In the present invention, the spacer may be shrinkable around the axial line in a radial direction. With this configuration, in the case where the inner circumferential surfaces of a plurality of holes having different inner diameters are continuously processed, the spacer is made to shrink in accordance with the diameters of the holes and inserted into the holes, whereby a certain spacing between the rotation center axial line of the tool body and the peripheral wall surfaces of the holes can be maintained. Accordingly, the frequency of change of the spacer in accordance with the inner diameters of the holes to be processed can be decreased.

In the present invention, the spacer may have an outer diameter that increases gradually continuously or step by step from the grinding member side toward the shank side along the axial line. With this configuration, in the case where the inner circumferential surfaces of a plurality of holes having different inner diameters are continuously processed, the spacer is inserted partially into the holes, whereby a certain spacing between the rotation center axial line of the tool body and the peripheral wall surface of the holes can be maintained. Accordingly, the frequency of change of the spacer in accordance with the inner diameters of the holes to be processed can be decreased.

In the present invention, the spacer preferably includes a plurality of spacers disposed so as to be spaced from each other in a direction of the rotation center axial line. With this configuration, for example, in the case where the inner circumferential surface of a deep hole is processed with a tool body having a long shank, the plurality of spacers can maintain a certain spacing between the rotation center axis of the tool body and the peripheral wall surface of the hole, thereby preventing the run-out of the tool body.

In the present invention, the tool body may include a through hole that penetrates in a direction of the rotation center axial line. With this configuration, even when the opening of a hole is blocked by the insertion of the spacer into the hole, machining oil and air can be supplied into the hole via the through hole, and a processed part can be cooled.

In the present invention, the grinding member holder may include: an annular holder body part holding the rear end of the grinding member; a bar-shaped part penetrating the holder body part and slidably supporting the holder body part in a direction of the rotation center axial line; and a fixing mechanism fixing the holder body part to the bar-shaped part, and the shank may extend backward from the bar-shaped part. With this configuration, the holder body part is slid in the direction of the rotation center axial line and fixed to the bar-shaped part, whereby the front end of the grinding member can be disposed at a desired position corresponding to the depth of a hole. Furthermore, also in the case where the grinding member is worn out by processing operation, the front end of the grinding member can be disposed at a desired position by sliding the holder body part forward. Furthermore, in the case where the grinding member is worn out, it is only required to pull out the holder body part from the bar-shaped part and replace the holder body part with a new one, and thus, the bar-shaped part can be reused.

In the present invention, the grinding member preferably includes a plurality of linear grinding members, and the grinding member holder preferably holds rear ends of the plurality of linear grinding members in a bundle. When the tool body is a brush-shaped grindstone including a plurality of linear grinding members, processing, such as polishing of the bottom of a hole, polishing of a corner between the bottom and the peripheral wall surface of a hole, and deburring of the edge of a hole intersecting with this hole, can be performed with high accuracy.

In the present invention, the grinding member holder and the grinding member preferably constitute a polishing tool, and the polishing tool preferably includes a connecting part configured to detachably connect the shank to the grinding member holder. With this configuration, a plurality of shanks having different lengths is prepared, and a shank corresponding to the depth of a hole is connected to the polishing tool, whereby the inner circumferential surfaces of a plurality of holes having different depths can be processed. Furthermore, in the case where the grinding member is worn out, the polishing tool can be replaced with a new one.

Next, the present invention provides a polishing tool included in the rotating tool.

The polishing tool of the present invention includes a connecting part to a shank, thereby being attachably and detachably connected to the shank, whereby the shank can be changed in accordance with the depth of a hole.

Furthermore, the present invention provides a processing method of processing the inner circumferential surface of a hole having a certain depth formed in a workpiece with a rotating tool including a grinding member, a grinding member holder holding rear ends of the grinding member, and a shank extending backward coaxially from the grinding member holder, the processing method including inserting a spacer into the hole, and rotating the tool body in a state that a certain spacing between the rotation center axial line of the tool body and the peripheral wall surface of the hole is maintained by the spacer.

According to the present invention, when the inner circumferential surface of a hole formed in a workpiece is processed, a certain spacing between the rotation center axial line of the tool body and the peripheral wall surface of the hole is maintained by the spacer. With this configuration, the run-out of the tool body is reduced, whereby a decrease in the accuracy of processing is reduced. Furthermore, since the run-out of the tool body is reduced, a workpiece can be prevented from being damaged by a contact of the workpiece with the grinding member holder or the shank. Furthermore, the shank can be prevented from being bent or broken due to the run-out.

DESCRIPTION OF EMBODIMENTS

Rotating tools according to the present invention are described below with reference to the drawings.

Embodiment 1

Figure 1A:
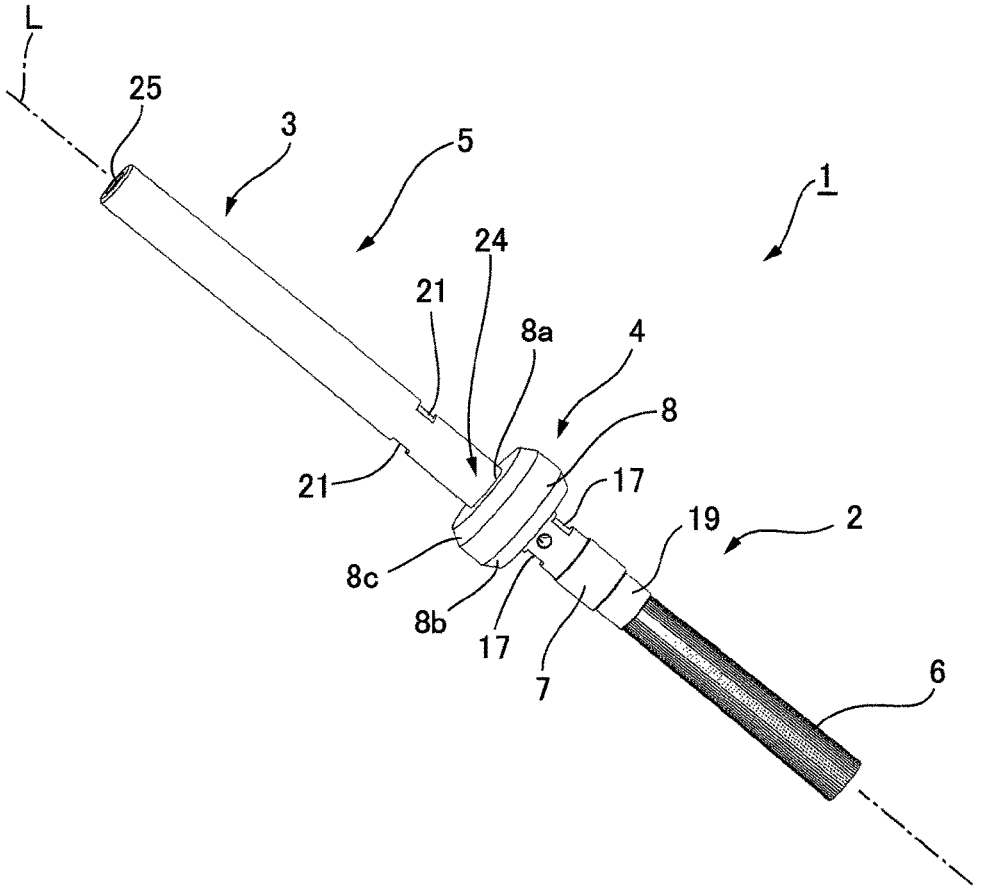
FIG. 1 is a perspective view and a cross-sectional view of a rotating tool of Embodiment 1.
Figure 1B:
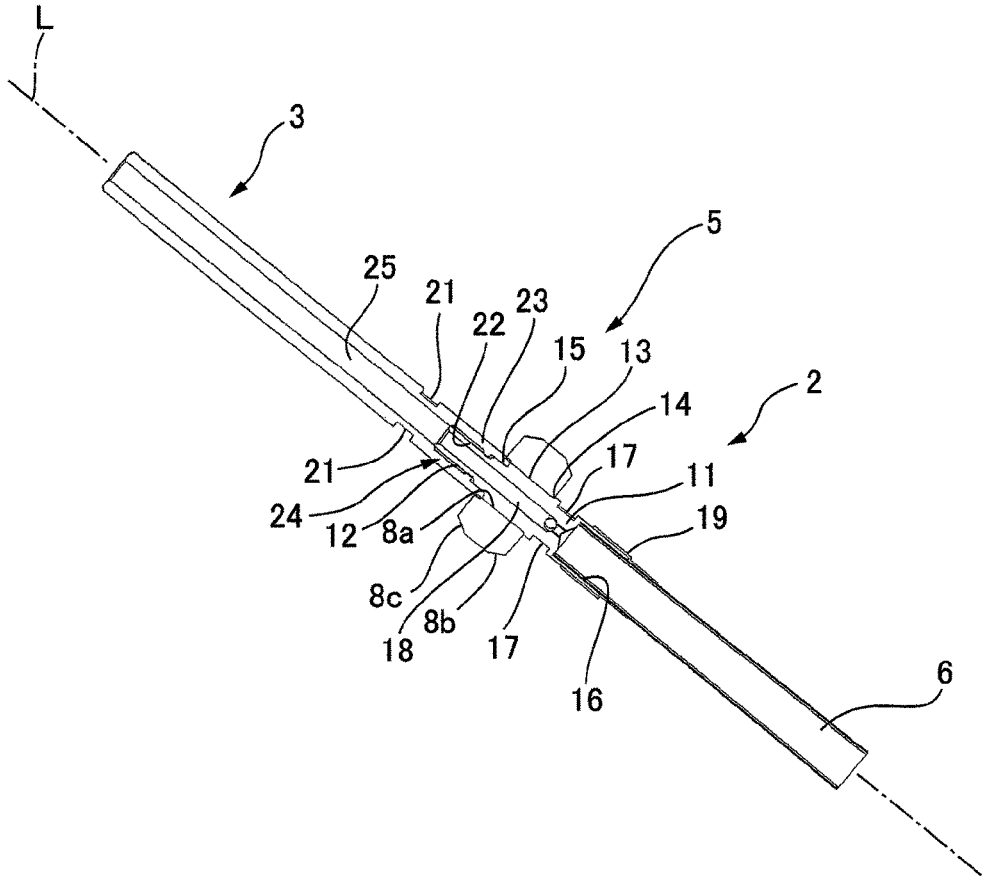
Figure 2:
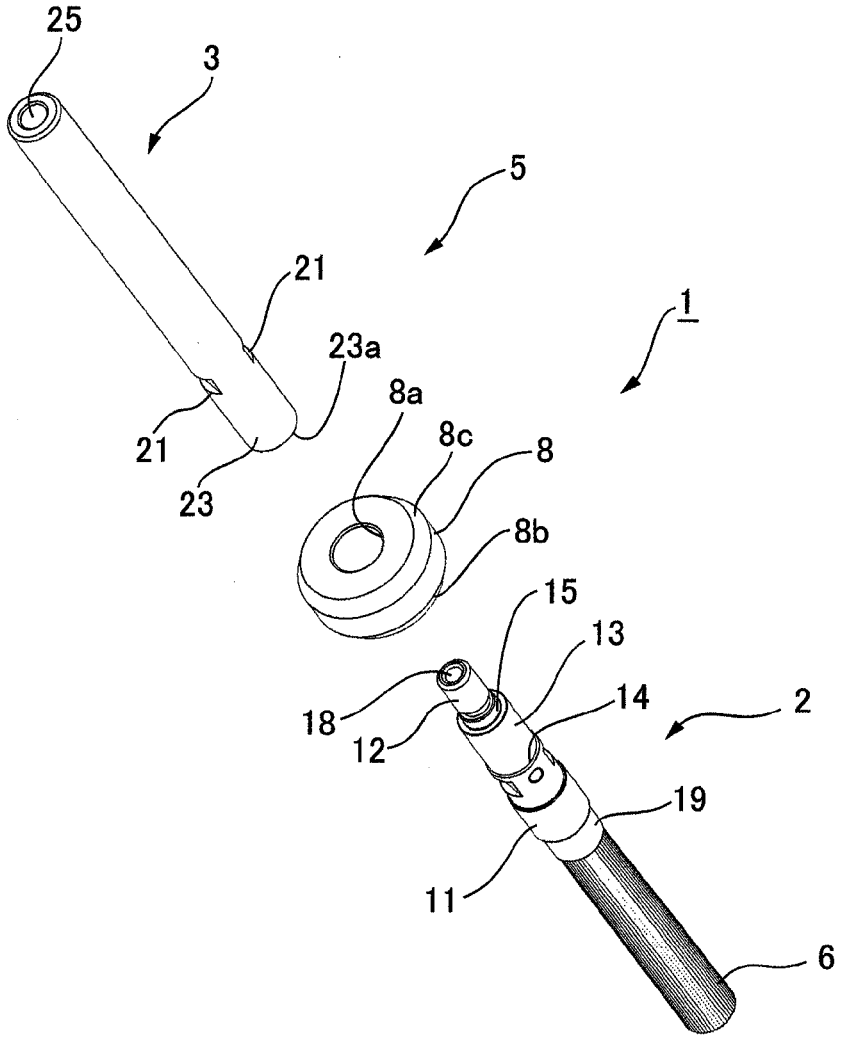
FIG. 2 is an exploded perspective view of the rotating tool illustrated in FIG. 1.
Figure 3:
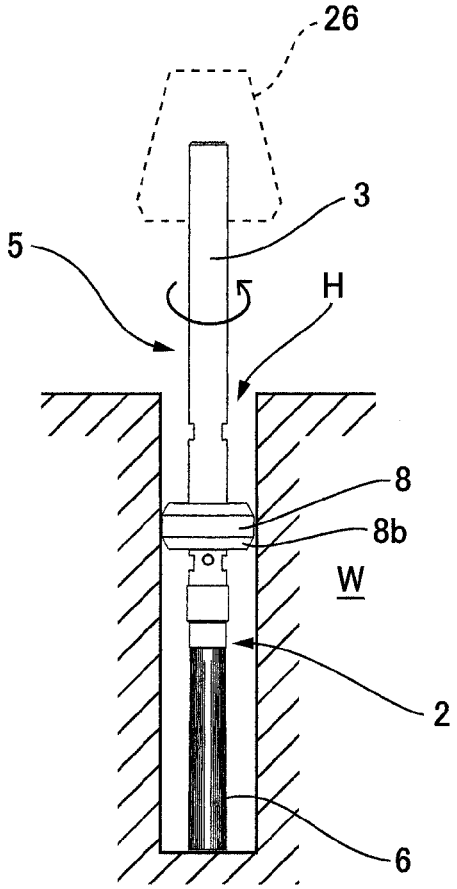
FIG. 3 is an illustration of a processing method using the rotating tool illustrated in FIG. 1.

FIG. 1(*a*) is a perspective view of a rotating tool of the present embodiment, and FIG. 1(*b*) is a cross-sectional view of the rotating tool of the present embodiment, including the axial line of the rotating tool. FIG. 2 is an exploded perspective view of the rotating tool illustrated in FIG. 1. FIG. 3 is an illustration of a method of processing the inner circumferential surface of a hole with this rotating tool 1 of the present embodiment. The rotating tool 1 of the present embodiment is attached to a machine tool such as a machining center, or to a manual rotating machine tool to perform polishing of the inner circumferential surface of a hole formed in a workpiece and deburring of the edge of another hole intersecting with the above-mentioned hole. As illustrated in FIG. 1(*a*), the rotating tool 1 includes a polishing tool 2 and a shank 3 which are coaxially connected to each other in the direction of an axial line L, and a flange part 4. The polishing tool 2 and the shank 3 constitute a tool body 5, and the flange part 4 is provided at some point in the tool body 5 in the direction of the axial line L (rotation center axial line). The flange part 4 is a part projecting toward the outer circumference side, and, in the present embodiment, the flange part 4 is composed of an annular member (spacer) 8, which is a component separate from the tool body 5. Hereinafter, the rotating tool 1 is described with the polishing tool 2 side as the front and the shank 3 side as the rear.

The polishing tool 2 includes a plurality of linear grinding members (grinding members) 6, and a grinding member holder 7 holding the rear ends of the linear grinding members 6. In the present embodiment, the flange part 4 is an annular member 8, which is coaxially attached to the grinding member holder 7.

The linear grinding members 6 each are such that an aggregate of inorganic filaments, such as aluminum filaments, is impregnated with a resin binder, such as an epoxy resin or a silicone resin, and cured to be shaped in a line. The linear grinding members 6 are held by the grinding member holder 7, thereby being brush-shaped. Note that, as the linear grinding members held by the grinding member holder 7, nylon, abrasive grain-containing nylon, abrasive grain-containing rubber, or a metal wire made of stainless steel, brass, or the like may be used. Furthermore, an annular grindstone may be used in place of the linear grinding members. Examples of the grindstone include a rubber grindstone containing abrasive grains.

The grinding member holder 7 is made of metal and has a cylindrical external shape. As illustrated in FIG. 1(*b*), the grinding member holder 7 includes a grinding member holding part 11 on the front side thereof to hold the linear grinding members 6. Furthermore, as illustrated in FIG. 2, the grinding member holder 7 includes a tool-side threaded part 12 at the rear end thereof. The tool-side threaded part 12 is a connecting part on the polishing tool 2 side to connect the shank 3 to the polishing tool 2. The tool-side threaded part 12 has a cylindrical shape, and a male thread is formed in the outer circumferential surface of the tool-side threaded part 12. A fitted part 13 to fit the annular member 8 therein is provided between the tool-side threaded part 12 and the grinding member holding part 11. The outer diameter of the fitted part 13 is smaller than the outside dimension of the grinding member holding part 11. The outer diameter of the tool-side threaded part 12 is smaller than the outer diameter of the fitted part 13. Accordingly, a first stage (a first movement-regulation part) 14 including a first annular end surface facing backward is formed between the grinding member holding part 11 and the fitted part 13. A second stage 15 including a second annular end surface facing backward is formed between the fitted part 13 and the tool-side threaded part 12. Note that the grinding member holder 7 may also be made of resin.

As illustrated in FIG. 1(*b*), a grinding member holding recess 16 having a circular shape and being recessed in the direction of the axial line L is formed at the center of the front end surface of the grinding member holder 7, that is, the front end surface of the grinding member holding part 11. The rear ends of the plurality of linear grinding members 6 are inserted in a bundle into the grinding member holding recess 16, and fixed thereto by an adhesive. In the outer circumferential surface of the grinding member holding part 11, a pair of cut-out portions 17 cut from the outer circumference side is formed on both sides across the axial line L. Each of the cut-out portions 17 in a pair has a cut-out surface parallel to the axial line L. The grinding member holder 7 includes a holder through hole 18 that penetrates the tool-side threaded part 12, the fitted part 13, and the grinding member holding part 11 in the direction of the axial line L. The front end opening of the holder through hole 18 is formed in the bottom of the grinding member holding recess 16. The front end of the grinding member holding part 11 and a portion of the linear grinding members 6 that is adjacent to the grinding member holding part 11 are covered with a heat shrinkable tube 19.

The annular member 8 is made of resin. The annular member 8 is held by the grinding member holder 7 in a state that the fitted part 13 is inserted in a center hole 8*a* of the annular member 8. The inner diameter of the center hole 8*a* of the annular member 8 is larger than the outer diameter of the fitted part 13, and smaller than the outer diameter of the grinding member holding part 11. The length of the annular member 8 in the direction of the axial line L is shorter than the length of the fitted part 13 in the direction of the axial line L. Hence, the annular member 8 is rotatable relative to the grinding member holder 7 in a state of being fitted to the fitted part 13. Furthermore, the annular member 8 is movable relative to the fitted part 13 in the direction of the axial line L in a state of being fitted to the fitted part 13. The annular member 8 may also be made of rubber or metal.

In the outer circumferential edge of the front end surface of the annular member 8, a first tapered surface 8*b* widening backward toward the outer circumference side is formed. In the outer circumferential edge of the rear end surface of the annular member 8, a second tapered surface 8*c* widening forward toward the outer circumference side is formed. The annular member 8 has a shape having symmetry with respect to a virtual plane perpendicular to the axial line L at the center in the direction of the axial line L.

The shank 3 is made of metal and has a cylindrical external shape. The outer diameter of the shank 3 is equal to the outside dimension of the grinding member holding part 11 of the grinding member holder 7. In the outer circumferential surface on the front side of the shank 3, a pair of cut-out portions 21 cut from the outer circumference side is formed on both sides across the axial line L. Each of the cut-out portions 21 in a pair has a cut-out surface parallel to the axial line L.

At the center of the front end surface of the shank 3, a circular connecting recess 22 recessed in the direction of the axial line L is formed as illustrated in FIG. 1(*b*). In the inner circumferential surface of an annular wall 23 surrounding the connecting recess 22, a female thread into which the tool-side threaded part 12 is screwed is formed. The connecting recess 22 is a connecting part on the shank 3 side to connect the shank 3 to the polishing tool 2, and constitutes a connecting part 24 of the polishing tool 2 and the shank, together with the tool-side threaded part 12 of the polishing tool 2. Furthermore, the shank 3 includes a shank through hole 25 penetrating in the direction of the axial line L. The front end opening of the shank through hole 25 is formed in the bottom of the connecting recess 22. The shank 3 may also be made of carbon fiber reinforced plastics.

(Assembly of Rotating Tool)

In the assembly of the rotating tool 1, the shank 3 having a length corresponding to the depth of a hole H to be processed (refer to FIG. 3) that is provided in a workpiece W is prepared. Furthermore, the annular member 8 having an outer diameter corresponding to the inner diameter of the hole H to be processed is prepared. The outer diameter of the annular member 8 is preferably set such that the outer circumferential surface of the annular member 8 fits with the peripheral wall surface of the hole H, or the outer circumferential surface of the annular member 8 faces the peripheral wall surface with a small clearance therebetween.

Next, the rear end of the grinding member holder 7 is inserted into the center hole 8*a* of the annular member 8 so that the annular member 8 is held by the fitted part 13. Subsequently, the tool-side threaded part 12 of the polishing tool 2 is screwed into the connecting recess 22 of the shank 3 so as to bring the front end surface of the annular wall 23 of the connecting recess 22 into contact with the second stage 15 between the fitted part 13 and the tool-side threaded part 12. Here, the contact of the front end surface of the annular wall 23 of the connecting recess 22 with the second stage 15 can prevent axial displacement between the shank 3 and the grinding member holder 7 by loose fit tolerance. The screwing of the tool-side threaded part 12 into the connecting recess 22 is performed by engaging a tool such as a spanner in the cut-out portions 17 and the cut-out portions 21 formed in the grinding member holder 7 and the shank 3, respectively.

The shank 3 is connected to the grinding member holder 7 to constitute the tool body 5, so that the annular member 8 is attached to the grinding member holder 7 in a state that the movement of the annular member 8 in the direction of the axial line L is regulated in the range of the fitted part 13. That is, when the annular member 8 moves forward, the annular member 8 comes into contact with the first stage 14 (the first movement-regulation part) between the fitted part 13 and the grinding member holding part 11, whereby the forward movement of the annular member 8 is regulated. When the annular member 8 moves backward, the annular member 8 comes into contact with a front end surface 23*a* (a second movement-regulation part) of the annular wall 23 of the shank 3, whereby the backward movement of the annular member 8 is regulated. Furthermore, when the shank 3 is connected to the grinding member holder 7, the shank through hole 25 of the shank 3 communicates with the holder through hole 18 of the grinding member holder 7.

(Processing Operation)

When the inner circumferential surface of the hole H formed in the workpiece W is polished, the shank 3 of the tool body 5 is connected to a rotating head of a machine tool via a tool holder 26 or the like, as illustrated in FIG. 3. Subsequently, the polishing tool 2 and the annular member 8 are inserted into the hole H. The insertion of the annular member 8 into the hole H can be performed using the first tapered surface 8*b* as a guide face.

Thereafter, the tool body 5 is rotationally driven to polish the inner circumferential surface of the hole H by the linear grinding members 6. Here, in the case where the shank 3 is made longer for the purpose of polishing a portion near the bottom of the inner circumferential surface of the hole H, large run-outs can sometimes occur on the front side of the tool body 5 due to centrifugal force when the tool body 5 is driven. Such a run-out of the tool body 5 makes the position of the polishing tool 2 unstable, thereby causing a decrease in the accuracy of processing. Furthermore, when such a run-out occurs, there is a possibility that the grinding member holder 7 or the shank 3 may come into contact with the workpiece W, whereby the workpiece W may be damaged. Furthermore, the shank 3 is sometimes bent or broken due to the run-out.

To solve these problems, in the present embodiment, the annular member 8 is inserted into the hole H at the time of processing, whereby a certain spacing between the axial line L of the tool body 5 and the peripheral wall surface of the hole H is maintained by the annular member 8, so that the run-out range of the tool body 5 is regulated. That is, in the case where the run-out on the front side of the tool body 5 occurs due to the rotation of the tool body 5, the annular member 8 comes into contact with the peripheral wall surface of the hole H, thereby regulating the range of the run-out. As a result, the run-out of the polishing tool 2 is reduced, whereby the position of the polishing tool 2 is stabilized, and a decrease in the accuracy of processing can be prevented. Furthermore, the run-out of the tool body 5 is reduced, whereby the workpiece W can be prevented from being damaged by a contact of the grinding member holder 7 or the shank 3 with the workpiece W. Furthermore, the shank 3 can be prevented from being bent or broken due to the run-out.

In the present embodiment, the annular member 8 is attached to the grinding member holder 7 in a state of being movable in the direction of the axial line L and rotatable about the axial line L. With this configuration, when the annular member 8 comes into contact with the peripheral wall surface of the hole H, the annular member 8 moves independently of the grinding member holder 7, and accordingly, the rotation of the polishing tool 2 can be prevented from being inhibited. That is, the annular member 8 plays the role of a sliding bearing to support the grinding member holder 7 in the hole H, thereby reducing the run-out of the tool body 5. Furthermore, since the annular member 8 moves independently of the grinding member holder 7, when the annular member 8 comes into contact with the peripheral wall surface of the hole H, the movement of the tool body 5 in the direction of the axial line L can be prevented from being inhibited.

Furthermore, in the present embodiment, the movement range of the annular member 8 in the direction of the axial line L is regulated, and therefore, although the annular member 8 is movable relative to the grinding member holder 7 in the direction of the axial line L, the annular member 8 can be prevented from moving toward the linear grinding member 6 side and interfering with the linear grinding members 6 during processing operation. Furthermore, the annular member 8 can be prevented from moving toward the shank 3 side and coming out of the hole H during processing operation.

In the present embodiment, the shank 3 is connected to the polishing tool 2 with the threads, and therefore can be easily attached thereto and detached therefrom. Hence, in the case where the linear grinding members 6 are worn out by repeating polishing, the polishing tool 2 can be easily replaced with a new one.

Furthermore, in the present embodiment, the shank through hole 25 of the shank 3 communicates with the holder through hole 18 of the grinding member holder 7, and therefore, even when the opening of the hole H is blocked by the insertion of a member into the hole H during processing, machining oil and air can be supplied into the hole H via the shank through hole 25 and the holder through hole 18.

Modification of Embodiment 1

In the above-mentioned embodiment, the connecting recess 22 having a female thread is formed on the shank 3 side, and the tool-side threaded part 12 into which a female thread is screwed is formed on the grinding member holder 7 side. However, a connecting recess having a female thread may be formed on the grinding member holder 7 side, and a threaded part to be screwed into a female thread may be formed on the shank 3 side.

Furthermore, in the case where a connecting recess having a female thread is formed on the grinding member holder 7 side and a threaded part to be screwed into a female thread is formed on the shank 3 side, a configuration may be adopted in which a fitted part having a small diameter is provided on the shank 3 side and the annular member 8 is held on the shank 3 side.

Embodiment 2

Figure 4A:
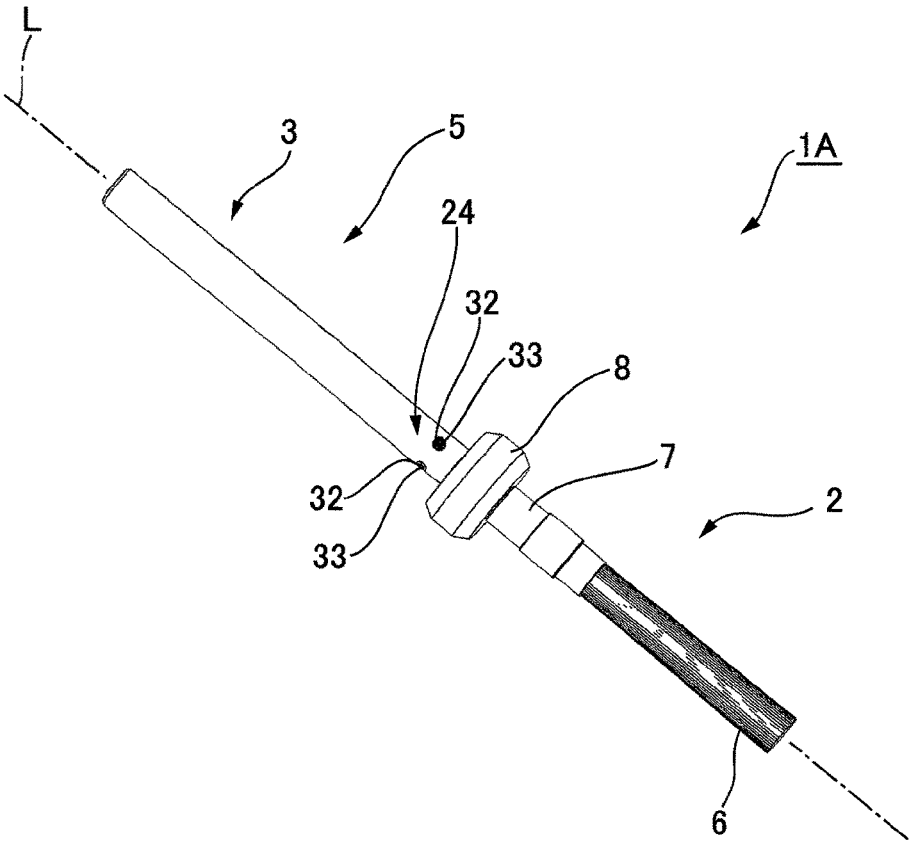
FIG. 4 is a perspective view and a cross-sectional view of a rotating tool of Embodiment 2.
Figure 4B:
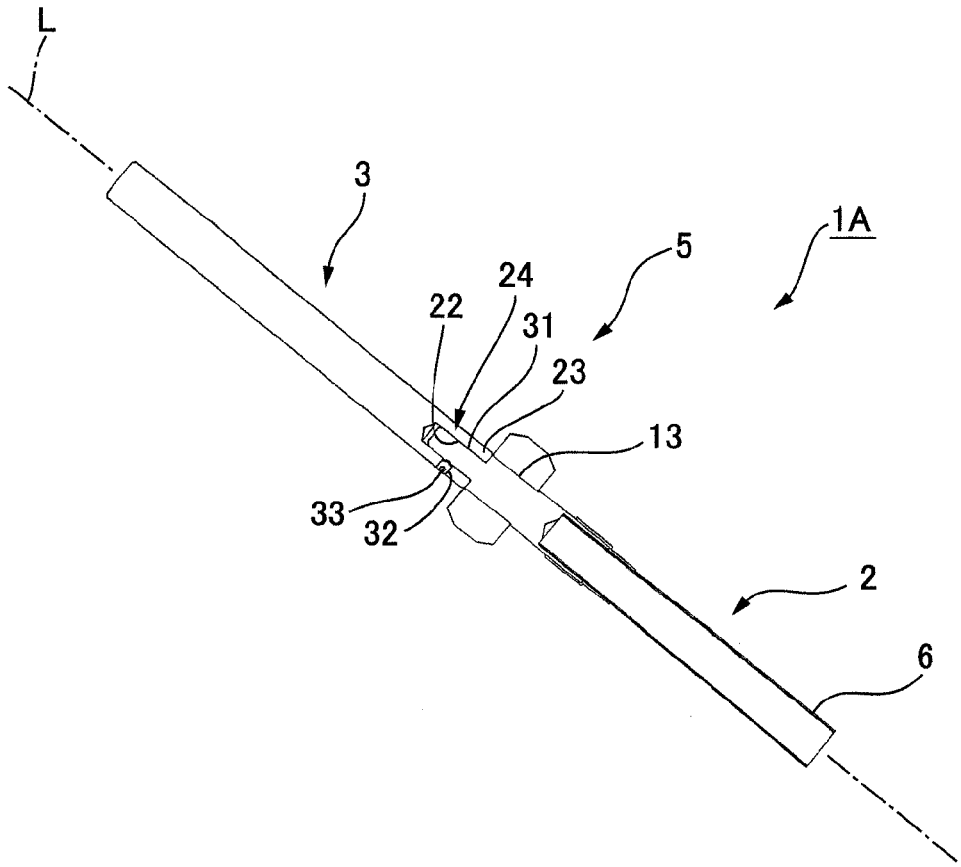

FIG. 4(*a*) is a perspective view of a rotating tool of the present embodiment, and FIG. 4(*b*) is a cross-sectional view of the rotating tool of the present embodiment, including the axial line of the rotating tool. The rotating tool 1A of the present embodiment differs from the rotating tool 1 of Embodiment 1 in the configuration of the connecting part 24 to connect the shank 3 to the grinding member holder 7. Furthermore, the rotating tool 1A of the present embodiment differs from the rotating tool 1 of Embodiment 1 in that the rotating tool 1A is not provided with the cut-out portions 17 and the cut-out portions 21, and is not provided with the shank through hole 25 and the holder through hole 18. Note that the rotating tool 1A of the present embodiment has the same configuration, other than the above, as that of the rotating tool 1. Therefore, common reference signs are given to common constituents, and descriptions thereof are omitted.

The grinding member holder 7 includes a small-diameter cylindrical part (insertion part) 31 having an outside dimension smaller than that of the fitted part 13 on the rear side of the fitted part 13, as illustrated in FIG. 4(*b*). The small-diameter part 31 is a connecting part on the polishing tool 2 side to connect the shank 3 to the polishing tool 2. At the center of the front end surface of the shank 3, the circular connecting recess 22 recessed in the direction of the axial line L is formed. The connecting recess 22 is a connecting part on the shank 3 side to connect the shank 3 to the polishing tool 2, and has a shape fittable with the small-diameter tubular part. In the annular wall 23 surrounding the connecting recess 22, two threaded holes 32 that penetrate the annular wall 23 in a direction perpendicular to the axial line L are formed. The two threaded holes 32 are provided to be spaced at an angle of 90° about the axial line L. A connecting screw 33 is screwed into each of the threaded holes 32 from the outer circumference side. Note that the spacing angle between the two threaded holes 32 is not limited to 90°, and the threaded holes may be spaced at an angle of 120°. However, a spacing angle of 180° easily causes looseness, and therefore, a spacing angle of 180° is preferably avoided.

In the assembly of the rotating tool 1A, the small-diameter part 31 of the polishing tool 2 is inserted into the connecting recess 22 of the shank 3. Next, each of the connecting screws 33 is screwed into the corresponding one of the threaded holes 32 from the outside of the annular wall 23. Then, the tip ends of the connecting screws 33 come into contact with the small-diameter part 31, whereby the grinding member holder 7 and the shank 3 are fixed.

According to the present embodiment, the same operational effects as those of the rotating tool 1 of Embodiment 1 can be achieved. Furthermore, according to the present embodiment, the configuration of the connecting part 24 of the polishing tool 2 to the shank 3 can be made simpler, whereby the cost of manufacturing the polishing tool 2, which is a consumable, can be reduced.

In the case where the grinding member holder 7 is connected to the shank 3 by the threaded hole 32 provided in one of the shank 3 and the grinding member holder 7 and a threaded part provided in the other, the connection between the shank 3 and the grinding member holder 7 is sometimes loosened by the rotational driving of the tool body 5. However, when the grinding member holder 7 is connected to the shank 3 by the connecting screws 33, such looseness can be avoided.

Modification of Embodiment 2

As is the case with the rotating tool 1, the rotating tool 1A of the present embodiment may have a configuration in which the grinding member holder 7 has the holder through hole 18; the shank 3 has the shank through hole 25; and, when the grinding member holder 7 is connected to the shank 3, the holder through hole 18 is connected to the shank through hole 25.

Furthermore, in the embodiment above, the grinding member holder 7 includes the small-diameter part (insertion part) 31, and the front end surface of the shank 3 is provided with the connecting recess 22. However, a configuration may be adopted in which the rear end surface of the grinding member holder 7 is provided with a connecting recess having a threaded hole; the front side of the shank 3 is provided with a small-diameter part (insertion part), and the grinding member holder 7 is connected to the shank 3 by a screw screwed into the threaded hole.

Embodiment 3

Figure 5A:
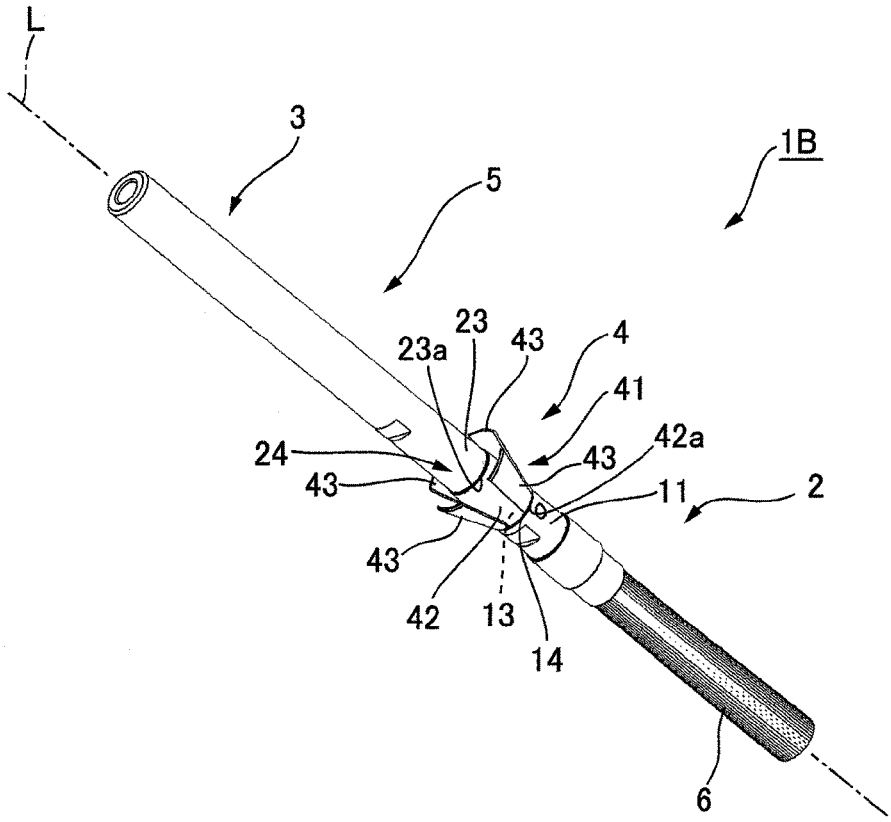
FIG. 5 is a perspective view of a rotating tool of Embodiment 3 and a perspective view of an annular member.
Figure 5B:
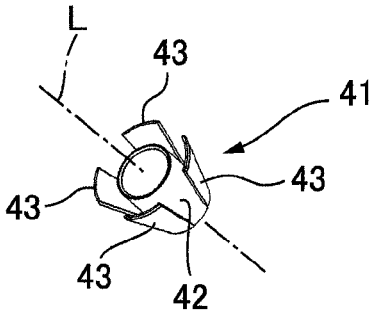

FIG. 5(*a*) is a perspective view of a rotating tool of the present embodiment, and FIG. 5(*b*) is a perspective view of an annular member. A rotating tool 1B of the present embodiment differs from the rotating tool 1 of Embodiment 1 in the shape of an annular member 41 included in the flange part 4. Note that the rotating tool 1B of the present embodiment has the same configuration, except the annular member 41, as that of the rotating tool 1 of Embodiment 1. Therefore, common reference signs are given to common constituents, and descriptions thereof are omitted.

The annular member 41 includes: an annular part 42 in which the fitted part 13 is inserted into the center hole 8*a*;

and a plurality of plate-shaped extension parts 43 extending radially backward from the annular part 42 to the outer circumference side. In the outer circumferential edge of the annular front end surface of the annular part 42, a tapered surface 42*a* inclined backward to the outer circumference side is provided. In the present embodiment, four sheets of the extension part 43 are provided. Each of the extension parts 43 has a tapered surface on the outer circumference side. Thus, the outer diameter of the annular member 41 gradually continuously increases backward. Furthermore, the rear end of each of the extension parts 43 is positioned at the rear of the rear end of the annular part 42. Here, the annular member 41 is an integrally molded product made of resin, and the extension part 43 can bend, with the spring property, to the inner circumference side toward the annular part 42. That is, the annular member 41 is shrinkable in the radial direction about the axial line L.

The annular member 41 is held by the grinding member holder 7 in a state of being rotatable about the axial line L and in a state that the movement of the annular member 41 in the forward and backward directions along the axial line L is regulated. That is, contact among the annular part 42, the fitted part 13, and the first stage 14 regulates the forward movement of the annular member 41, and contact between the annular part 42 and the front end surface 23*a* of the annular wall 23 of the shank 3 regulates the backward movement of the annular member 41.

(Processing Method)

Figure 6:
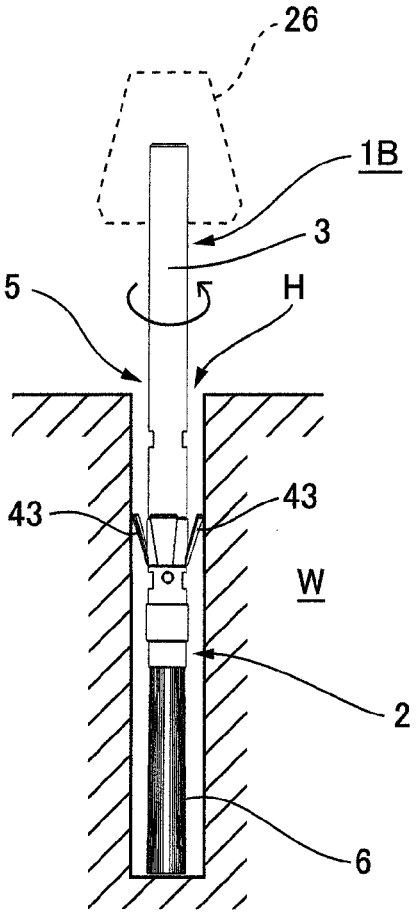
FIG. 6 is an illustration of a processing method using the rotating tool illustrated in FIG. 5.

FIG. 6 is an illustration of a processing method using the rotating tool 1B of the present embodiment. In the present embodiment, when the annular member 41 is inserted into the hole H to be processed, the extension parts 43 are brought into contact with the peripheral wall surface of the hole H, and the extension parts 43 are bent to the inner circumference side in accordance with the inner diameter of the hole H and inserted into the hole H. Thus, while the position of the polishing tool 2 is stabilized by the annular member 41, the polishing tool 2 can be guided into the hole H. In the present embodiment, the extension parts 43 of the annular member 41 are in contact with the peripheral wall surface of the hole H. When the annular member 41 comes into contact with the peripheral wall surface of the hole H, a certain spacing between the axial line L of the tool body 5 and the peripheral wall surface of the hole H is maintained by the annular member 41.

Thereafter, the tool body 5 is rotationally driven to polish the inner circumferential surface of the hole H with the linear grinding members 6. Here, the annular member 41 plays the role of a sliding bearing to support the grinding member holder 7 in the hole H. Accordingly, the run-out of the tool body 5 is reduced.

Furthermore, in the present embodiment, the extension parts 43 bend to the inner circumference side in accordance with the inner diameter of the hole H, and therefore, in the case where the inner circumferential surfaces of a plurality of holes H having different inner diameters are continuously processed, the frequency of change of the annular member 41 in accordance with the inner diameters of the holes H can be decreased.

Note that, in the rotating tool 1B of the present embodiment, the configuration of the connecting part 24 of the polishing tool 2 and the shank 3 may be a configuration using the connecting screws 33 as is the case with the connecting part 24 of the polishing tool 2 and the shank 3 in Embodiment 2.

Embodiment 4

Figure 7A:
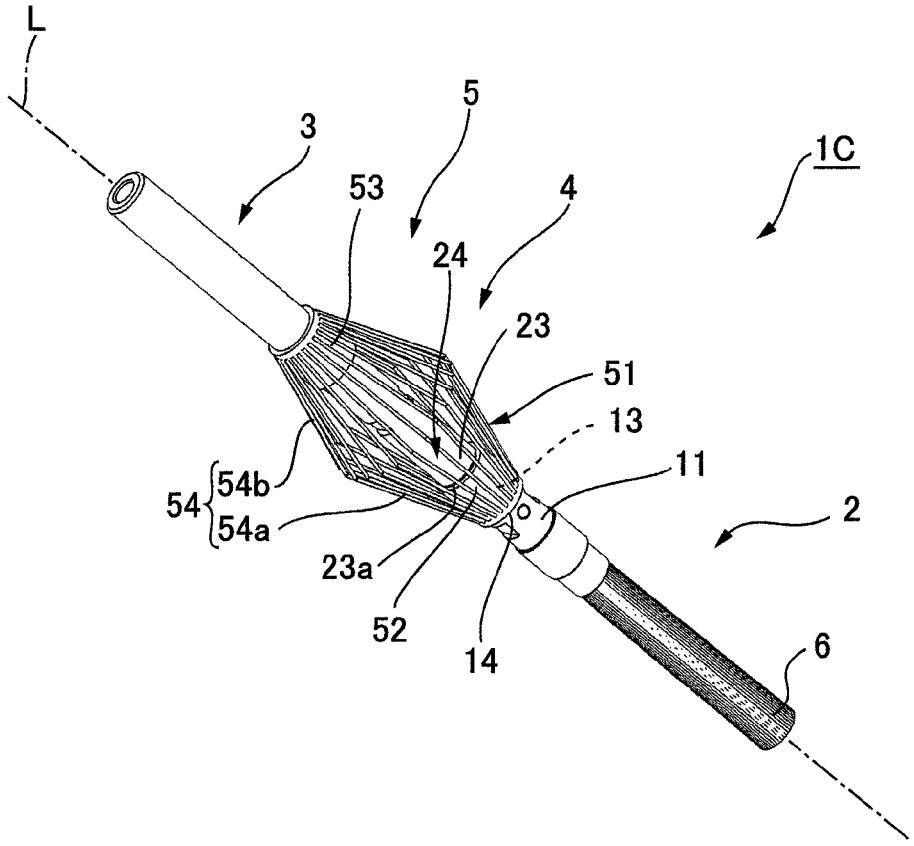
FIG. 7 is a perspective view of a rotating tool of Embodiment 4 and a perspective view of an annular member.
Figure 7B:
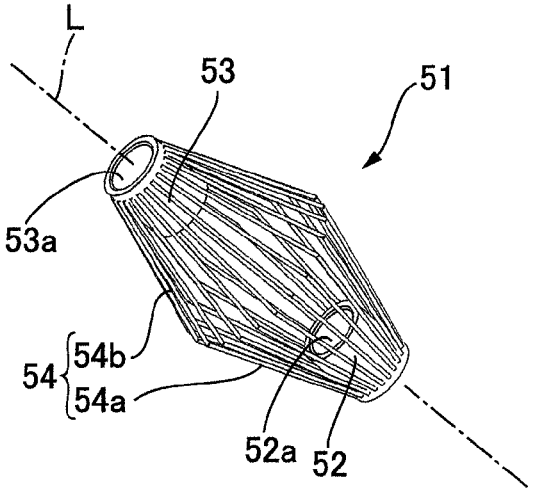

FIG. 7(*a*) is a perspective view of a rotating tool of the present embodiment, and FIG. 7(*b*) is a perspective view of an annular member. A rotating tool 1C of the present embodiment differs from the rotating tool 1 of Embodiment 1 in the shape of an annular member 51 included in the flange part 4. Note that the rotating tool 1C of the present embodiment has the same configuration, except the annular member 51, as that of the rotating tool 1 of Embodiment 1. Therefore, common reference signs are given to common constituents, and descriptions thereof are omitted.

The annular member 51 includes: a first annular part 52 in which the fitted part 13 is inserted into a center hole 52*a*; a second annular part 53 which is disposed so as to be spaced backward from the first annular part 52 in the direction of the axial line L and into whose center hole 53*a* the shank 3 is inserted; and a plurality of linear connecting parts 54 configured to connect the first annular part 52 to the second annular part 53. The first annular part 52 and the second annular part 53 are coaxially disposed, and the inner diameter of the second annular part 53 is larger than the inner diameter of the first annular part 52.

The plurality of linear connecting parts 54 are annularly disposed so as to surround the axial line L. Each of the linear connecting parts 54 includes: a front side portion 54*a* extending backward from the first annular part 52 to the outer circumference side; and a rear side portion 54*b* extending backward from the rear end of the front side portion 54*a* to the inner circumference side to be continuous to the second annular part 53. Here, the annular member 51 is an integrally molded product made of resin, and each of the linear connecting parts 54 can bend to the inner circumference side with spring property. That is, the annular member 51 is shrinkable in the radial direction about the axial line L taken as a center. Note that the annular member 51 may also be made of metal.

The first annular part 52 is fitted to the fitted part 13 in a state that the movement of the first annular part 52 in the forward and backward directions along the axial line L is regulated. That is, the contact of the first annular part 52 with the first stage 14 between the fitted part 13 and the grinding member holding part 11 regulates the forward movement of the annular member 51, and the contact of the first annular part 52 with the front end surface 23*a* of the annular wall 23 of the shank 3 regulates the backward movement of the annular member 51.

Here, the second annular part 53 has an inner diameter larger than the outside diameter of the shank 3. Therefore, the second annular part 53 is held by the shank 3 in a state that the second annular part 53 and the first annular part 52 are rotatable about the axial line L in an integrated manner. Furthermore, the second annular part 53 is movable relative to the shank 3 in the direction of the axial line L, and is capable of changing a distance from the first annular part 52 within a range that the linear connecting parts 54 bend.

(Processing Method)

Figure 8:
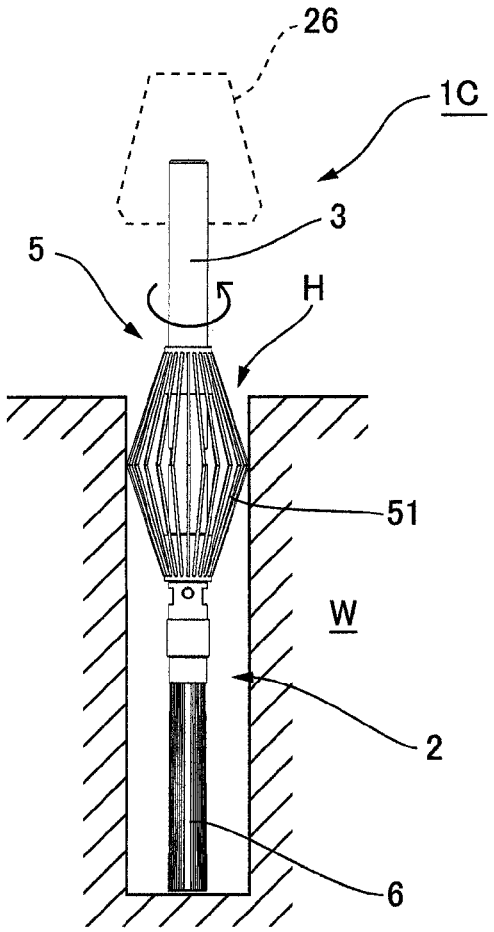
FIG. 8 is an illustration of a processing method using the rotating tool illustrated in FIG. 7.

FIG. 8 is an illustration of a processing method using the rotating tool 1C of the present embodiment. In the present embodiment, the annular member 51 is inserted into the hole H with each of the linear connecting parts 54 being brought into contact with the peripheral wall surface of the hole H and each of the linear connecting parts 54 being bent to the inner circumference side in accordance with the inner diameter of the hole H. The insertion of the annular member 51 into the hole H can be performed using the front side portions 54*a* of the annular member 51 as a guide face. Thus, the polishing tool 2 is inserted into the hole H in a state that the position of the polishing tool 2 is stable. Furthermore, in the present embodiment, the linear connecting parts 54 serve as a fixed part of the annular member 51 to the peripheral wall surface of the hole H. That is, when the linear connecting parts 54 come into contact with the peripheral wall surface of the hole H, reaction force acting on the linear connecting parts 54 allows the annular member 51 to be fixed to the hole H. When the annular member 51 is fixed to the hole H, a certain spacing between the axial line L of the tool body 5 and the peripheral wall surface of the hole H is maintained by the annular member 51.

Thereafter, the tool body 5 is rotationally driven to polish the inner circumferential surface of the hole H by the linear grinding member 6. Here, the annular member 51 plays the role of a sliding bearing to support the grinding member holder 7 in the hole H, and reduces the run-out of the tool body 5. Therefore, also in the present embodiment, the same operational effects as in Embodiment 1 can be achieved.

Furthermore, in the present embodiment, the linear connecting parts 54 bend to the inner circumference side in accordance with the inner diameter of the hole H, and therefore, in the case where the inner circumferential surfaces of a plurality of holes H having different inner diameters are continuously processed, the frequency of change of the annular member 51 in accordance with the inner diameters of the holes H can be decreased. Furthermore, in the present embodiment, each of the linear connecting parts 54 is linear and flexibly bends, thereby allowing the tool body 5 to be inclined in the hole H. Therefore, even when the hole H has a bottom-projecting shape, the bottom-projecting portion can be processed.

Note that, in the rotating tool 1C of the present embodiment, the configuration of the connecting part 24 of the polishing tool 2 and the shank 3 may be a configuration using the connecting screw 33, as is the case with the connecting part 24 of the polishing tool 2 and the shank 3 in Embodiment 2.

Embodiment 5

Figure 9A:
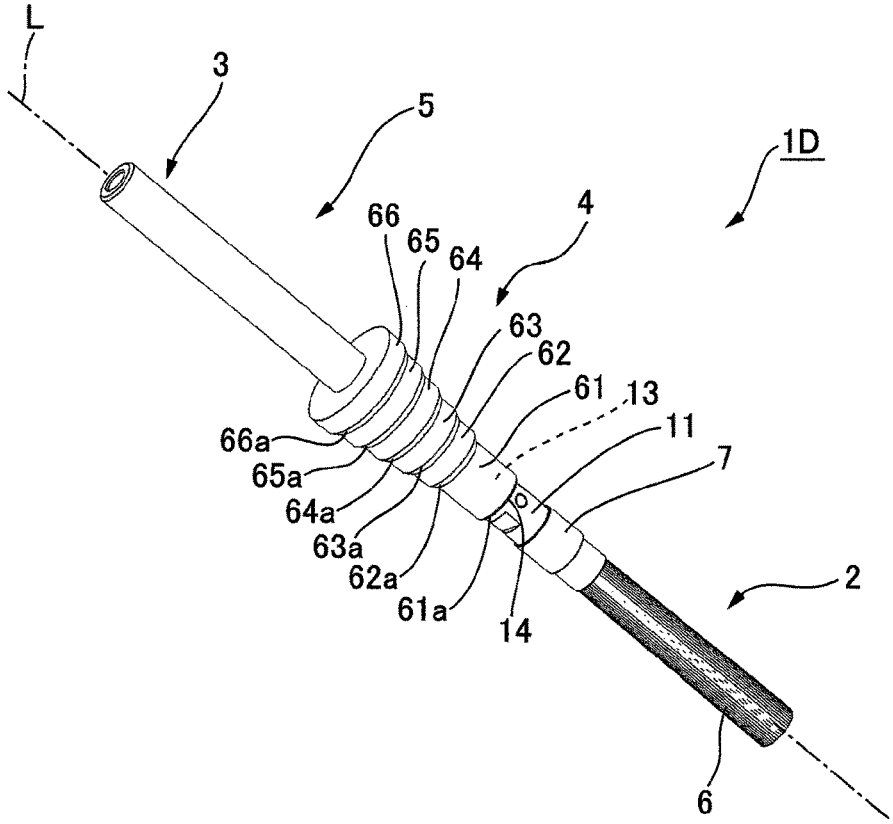
FIG. 9 is a perspective view and a cross-sectional view of a rotating tool of Embodiment 5.
Figure 9B:
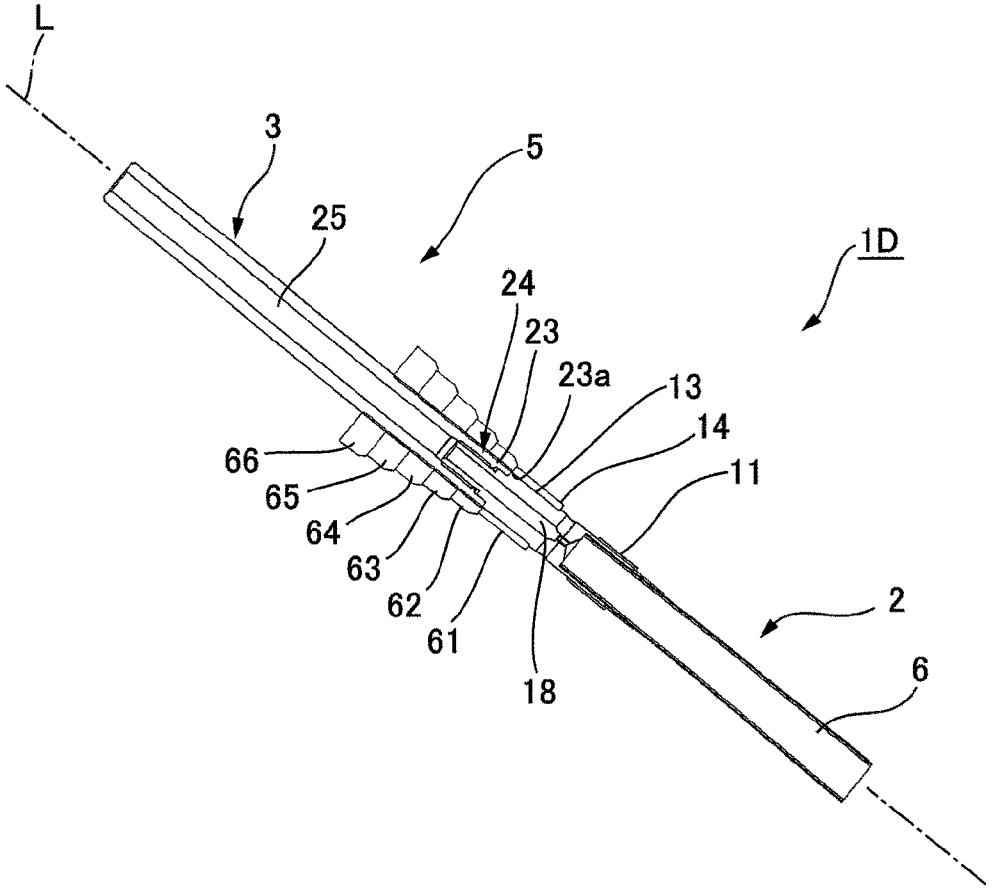

FIG. 9(*a*) is a perspective view of a rotating tool of the present embodiment, and FIG. 9(*b*) is a cross-sectional view of the rotating tool of the present embodiment, including the axial line L of the rotating tool. A rotating tool 1D of the present embodiment differs from the rotating tool 1 of Embodiment 1 in the configuration of the flange part 4. Note that the rotating tool 1D of the present embodiment has the same configuration, except an annular member 61, as that of the rotating tool 1 of Embodiment 1. Therefore, common reference signs are given to common constituents, and descriptions thereof are omitted.

As illustrated in FIG. 9(*a*), the flange part 4 includes a first annular member 61 to a sixth annular member 66, which are arranged in this order from the front to the rear. Any of the annular members 61 to 66 have an annular shape. In the outer circumferential edge of the annular front end surface of each of the annular members 61 to 66, the corresponding one of tapered surfaces 61*a* to 66*a* inclined backward to the outer circumference side is formed.

The first annular member 61 is fitted to the fitted part 13 of the grinding member holder 7 in a state of being movable in the direction of the axial line L and rotatable about the axial line L. That is, as illustrated in FIG. 9(*b*), the forward movement of the first annular member 61 from the first stage 14 between the fitted part 13 and the grinding member holding part 11 is regulated, and the backward movement of the first annular member 61 is regulated by the front end surface 23*a* of the annular wall 23 of the shank 3.

The second annular member 62 has an outer diameter larger than that of the first annular member 61, the third annular member 63 has an outer diameter larger than that of the second annular member 62, and the fourth annular member 64 has an outer diameter larger than that of the third annular member 63. Furthermore, the fifth annular member 65 has an outer diameter larger than that of the fourth annular member 64, and the sixth annular member 66 has an outer diameter larger than that of the fifth annular member 65. Hence, the outer diameter of the flange part 4 gradually increases backward along the axial line L. Any of the second annular member 62 to the sixth annular member 66 are held by the shank 3 in a state that any of the annular members 62 to 66 are movable in the direction of the axial line L and rotatable about the axial line L. Furthermore, the first annular member 61 regulates the forward movement of the second annular member 62 to the sixth annular member 66 in the direction of the axial line L.

(Processing Method)

Figure 10:
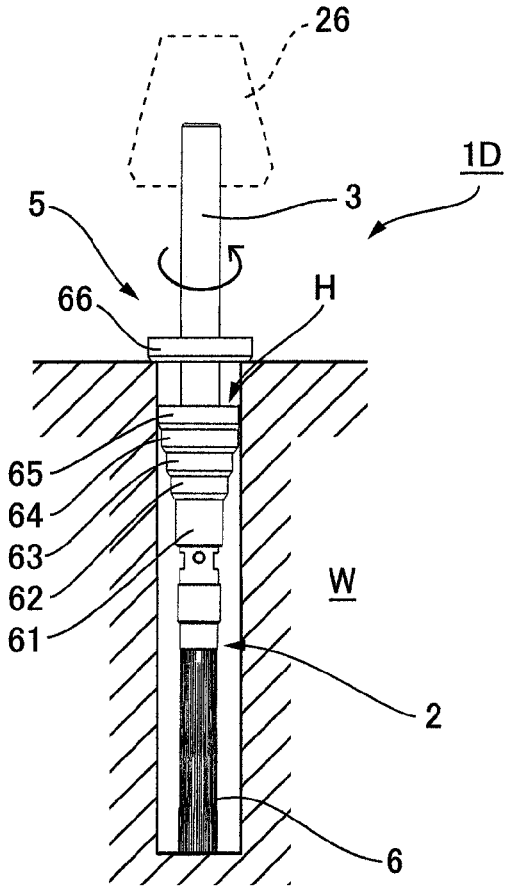
FIG. 10 is an illustration of a processing method using the rotating tool illustrated in FIG. 9.

FIG. 10 is an illustration of a processing method using the rotating tool 1D of the present embodiment. As illustrated in FIG. 10, the present embodiment is such that, in the processing of the inner circumferential surface of the hole H, among the first annular member 61 to the sixth annular member 66, the first annular member 61 to the fifth annular member 65, each having an outer diameter smaller than the inner diameter of the hole H, are dropped into the hole H by self-weight.

Thereafter, the rotating tool 1D is rotationally driven to polish the inner circumferential surface of the hole H by the linear grinding members 6. Here, when some of the annular members 61 to 65 are dropped into the hole H, a certain spacing between the axial line L of the rotating tool 1D and the peripheral wall surface of the hole H is maintained by the annular member 65 which has the largest diameter among the annular members 61 to 65 arranged in the hole H, whereby the run-out range of the rotating tool 1D is regulated. That is, when the rotating tool 1D is rotated, the annular member 65 comes into contact with the peripheral wall surface of the hole H, thereby preventing the run-out of the rotating tool 1D. Therefore, also in the present embodiment, the same operational effects as in Embodiment 1 can be achieved.

Furthermore, in the present embodiment, in the case where the inner circumferential surfaces of a plurality of holes H having different inner diameters are continuously processed, the frequency of change of the annular members in accordance with the inner diameters of the holes H can be decreased. That is, in the present embodiment, one or a plurality of the annular members 61 to 66 are inserted into the hole H in accordance with the inner diameter of the hole H, whereby the run-out of the rotating tool 1D can be reduced.

Note that the number of the annular members included in the flange part 4 is not limited to six.

Note that, in the rotating tool 1D of the present embodiment, the configuration of the connecting part 24 of the polishing tool 2 and the shank 3 may be a configuration using the connecting screw 33, as is the case with the connecting part 24 of the polishing tool 2 and the shank 3 in Embodiment 2.

Embodiment 6

Figure 11:
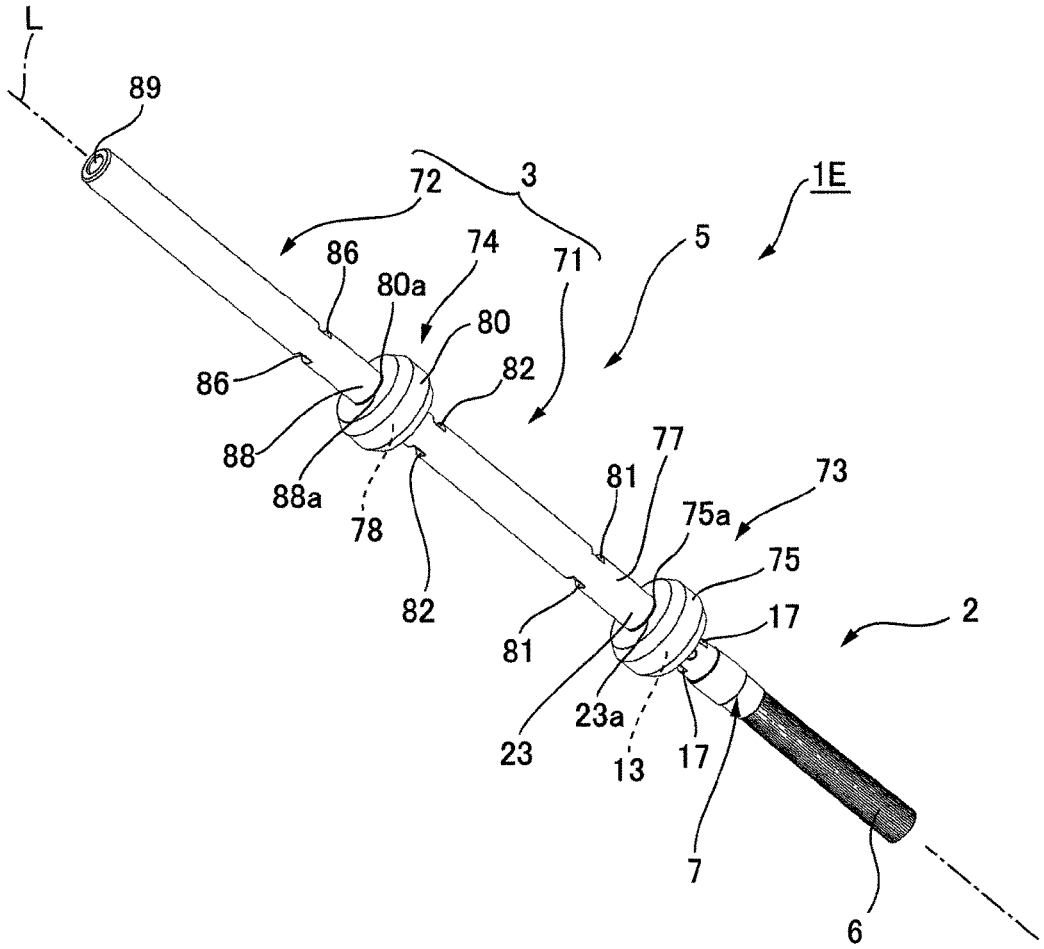
FIG. 11 is a perspective view of a rotating tool of Embodiment 6.
Figure 12:
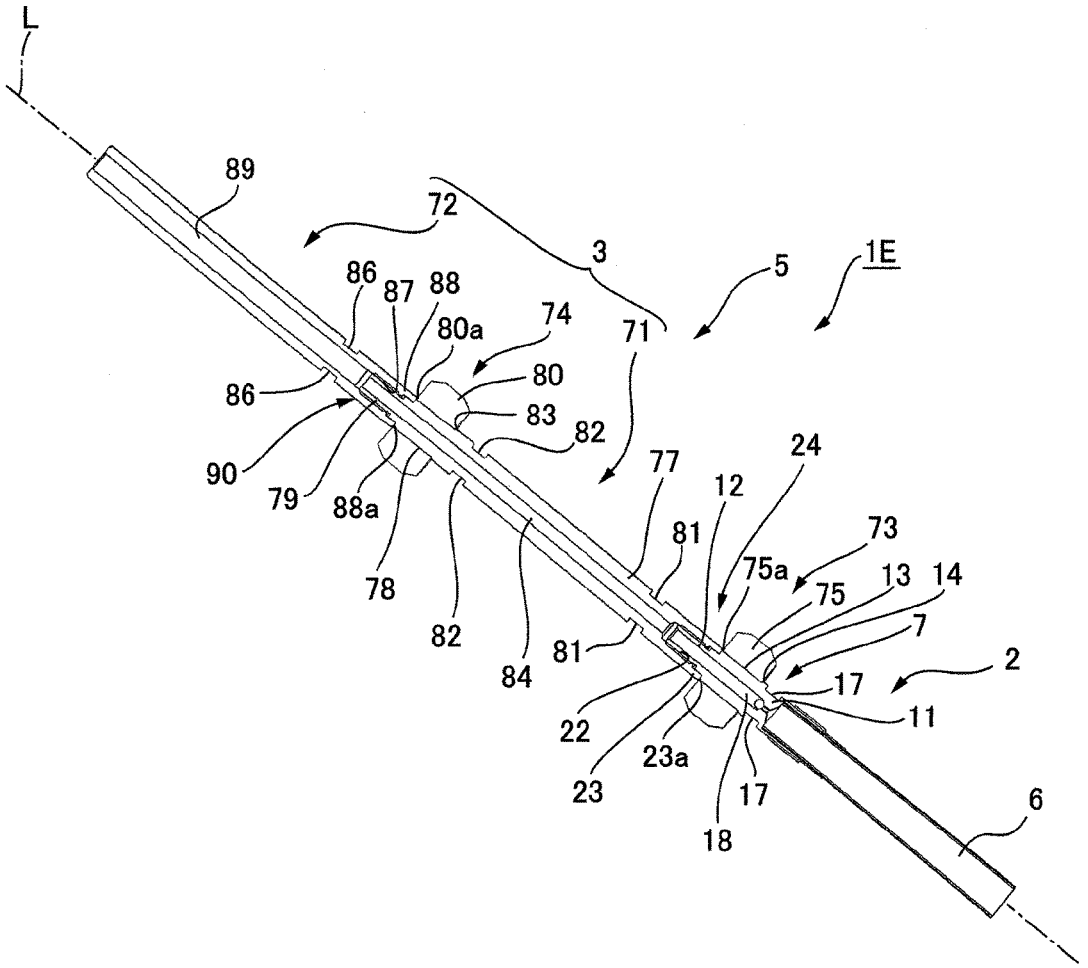
FIG. 12 is a cross-sectional view of the rotating tool illustrated in FIG. 11.

FIG. 11 is a perspective view of a rotating tool of the present embodiment. FIG. 12 is a cross-sectional view of the rotating tool of the present embodiment, including the axial line L of the rotating tool. Note that a rotating tool 1E of the present embodiment has the same configuration as that of the rotating tool 1 of Embodiment 1, and therefore, common reference signs are given to common constituents, and descriptions thereof are omitted.

As illustrated in FIG. 11, the rotating tool 1E of the present embodiment includes the polishing tool 2 and the shank 3 which are coaxially connected in the direction of the axial line L. In the present embodiment, the shank 3 includes a first shank 71, and a second shank 72 coaxially connected to the first shank 71 on the rear side of the first shank 71. Hence, the polishing tool 2, the first shank 71, and the second shank 72 constitute the tool body 5. Furthermore, in the present embodiment, as the flange part 4, a first annular member 73 provided in the tool body 5 and a second annular member 74 provided in the shank 3 are included. The second annular member 74 is provided in the rear end of the first shank 71.

The polishing tool 2 includes the plurality of linear grinding members 6, and the grinding member holder 7 holding the rear ends of the plurality of linear grinding members 6. The polishing tool 2 of the present embodiment has the same configuration as that of the polishing tool 2 of Embodiment 1. The first annular member 73 provided in the polishing tool 2 is composed of a first annular member 75, and attached to the fitted part 13 of the grinding member holder 7. The first annular member 75 has the same configuration as that of the annular member 8 of Embodiment 1, and is fitted to the fitted part 13 of the grinding member holder 7 in a state of being movable in the direction of the axial line L and rotatable about the axial line L. As illustrated in FIG. 12, the grinding member holder 7 includes the tool-side threaded part 12 adjacent to the rear side of the fitted part 13. Furthermore, the grinding member holder 7 includes the holder through hole 18 penetrating in the direction of the axial line L.

The first shank 71 is made of metal and has a cylindrical external shape. As illustrated in FIG. 12, the first shank 71 includes, from the front to the rear: a tube part 77 having an outer diameter equal to the outside dimension of the grinding member holding part 11 of the grinding member holder 7; a shank-side fitted part 78 having a diameter smaller than that of the tube part 77; and a shank-side threaded part 79 having a diameter smaller than that of the shank-side fitted part 78. Here, a second annular member 80 included in the second annular member 74 is fitted to the shank-side fitted part 78. The second annular member 80 is the same member as the first annular member 75. The length of the second annular member 80 in the axial line L direction is shorter than the length of the shank-side fitted part 78 in the axial line L direction. A male thread is formed in the outer circumferential surface of the shank-side threaded part 79.

In the outer circumferential surface on the front side of the tube part 77, a pair of first cut-out portions 81 cut from the outer circumference side is provided on both sides across the axial line L. Each of the first cut-out portions 81 in a pair has a cut-out surface parallel to the axial line L. At the center of the front end surface of the tube part 77, the circular connecting recess 22 recessed in the direction of the axial line L is formed. In the inner circumferential surface of the annular wall 23 surrounding the connecting recess 22, a female thread into which the tool-side threaded part 12 is screwed is formed.

In the outer circumferential surface on the rear side of the tube part 77, a pair of second cut-out portions 82 cut from the outer circumference side is provided on both sides across the axial line L. Each of the second cut-out portions 82 in a pair has a cut-out surface parallel to the axial line L. Between the shank-side fitted part 78 and the tube part 77, a shank-side stage 83 having an annular end surface facing backward is formed. Furthermore, the first shank 71 includes a first shank through hole 84 penetrating the shank-side threaded part 79, the shank-side fitted part 78, and the tube part 77 in the direction of the axial line L. The front end opening of the first shank through hole 84 is formed in the bottom of the connecting recess 22. Note that the first shank 71 may also be made of carbon fiber reinforced plastics.

The second shank 72 is made of metal and has a cylindrical external shape. The outer diameter of the second shank 72 is equal to the outside dimension of the tube part 77 of the first shank 71. In the outer circumferential surface on the front side of the first shank 71, a pair of cut-out portions 86 cut from the outer circumference side is provided on both sides across the axial line L. Each of the cut-out portions 86 in a pair has a cut-out surface parallel to the axial line L.

At the center of the front end surface of the second shank 72, a second circular connecting recess 87 recessed in the direction of the axial line L is formed. In the inner circumferential surface of an annular wall 88 surrounding the second connecting recess 87, a female thread into which the shank-side threaded part 79 is screwed is formed. Furthermore, the second shank 72 includes a second shank through hole 89 penetrating in the direction of the axial line L. The front end opening of the second shank through hole 89 is formed in the bottom of the second connecting recess 87. Note that the second shank 72 may also be made of carbon fiber reinforced plastics.

(Assembly of Rotating Tool)

When the rotating tool 1E of the present embodiment is assembled, the rear end of the grinding member holder 7 is inserted into a center hole 75*a* of the first annular member 75 so that the first annular member 75 is held by the fitted part 13. Thereafter, the tool-side threaded part 12 of the polishing tool 2 is screwed into the connecting recess 22 of the first shank 71. The screwing of the tool-side threaded part 12 into the connecting recess 22 is performed by engaging a tool such as a spanner in the cut-out portions 17 of the grinding member holder 7 and the first cut-out portions 81 of the first shank 71.

The grinding member holder 7 is connected to the first shank 71, so that the first annular member 75 is attached to the grinding member holder 7 in a state that the movement of the first annular member 75 in the forward and backward directions along the axial line L is regulated in the range of the fitted part 13. That is, the first stage 14 between the fitted part 13 and the grinding member holding part 11 of the grinding member holder 7 regulates the forward movement of the first annular member 75, and the front end surface 23*a* of the annular wall 23 of the first shank 71 regulates the backward movement of the first annular member 75. Furthermore, when the first shank 71 is connected to the grinding member holder 7, the first shank through hole 84 of the first shank 71 communicates with the holder through hole 18 of the grinding member holder 7.

Next, the rear end of the first shank 71 is inserted into a center hole 80*a* of the second annular member 80, so that the second annular member 80 is held by the shank-side fitted part 78. Thereafter, the shank-side threaded part 79 of the first shank 71 is screwed into the second connecting recess 87 of the second shank 72. The screwing of the shank-side threaded part 79 into the second connecting recess 87 is performed by engaging a tool such as a spanner in the second cut-out portions 82 of the first shank 71 and the cut-out portions 86 of the second shank 72.

The first shank 71 is connected to the second shank 72, so that the second annular member 80 is attached to the first shank 71 in a state that the movement of the second annular member 80 in the forward and backward directions along the axial line L is regulated in the range of the shank-side fitted part 78. That is, the shank-side stage 83 between the shank-side fitted part 78 and the tube part 77 of the first shank 71 regulates the forward movement of the second annular member 80, and the front end surface 88*a* of the annular wall 88 of the second shank 72 regulates the backward movement of the second annular member 80. Furthermore, when the first shank 71 is connected to the second shank 72, the first shank through hole 84 of the first shank 71 communicates with the second shank through hole 89 of the second shank 72. With this configuration, the first shank through hole 84, the second shank through hole 89, and the holder through hole 18 communicate with each other.

(Processing Method)

Figure 13:
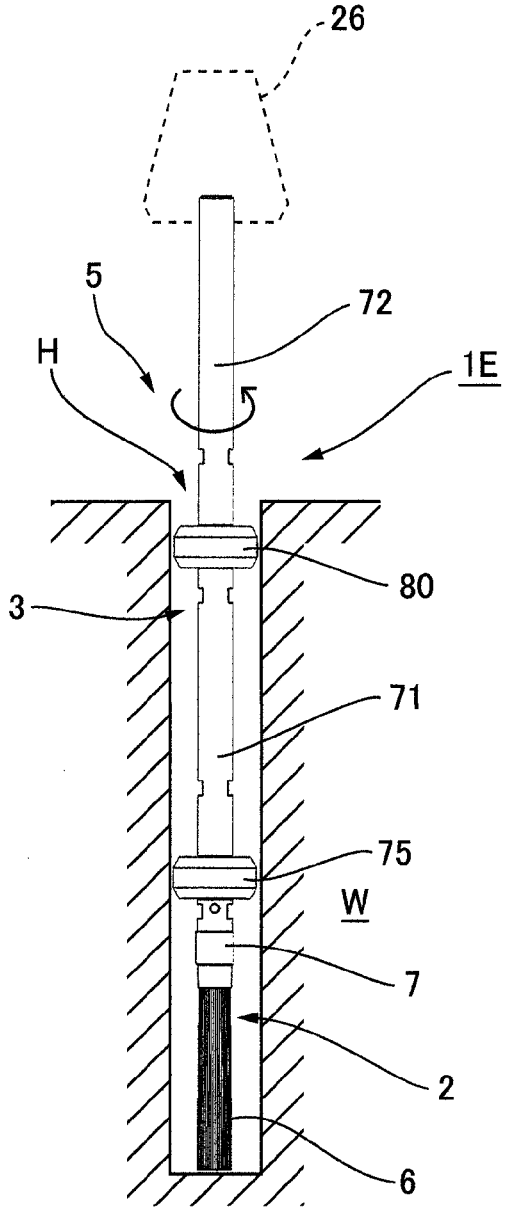
FIG. 13 is an illustration of a processing method using the rotating tool illustrated in FIG. 11.

FIG. 13 is an illustration of a method of processing the inner circumferential surface of the hole H using the rotating tool 1E of the present embodiment. When the inner circumferential surface of the hole H formed in the workpiece W is polished using the rotating tool 1E of the present embodiment, the polishing tool 2, the first annular member 75, the first shank 71, and the second annular member 80 are inserted into the hole H as illustrated in FIG. 12. Thereafter, the rotating tool 1E is rotationally driven to polish the inner circumferential surface of the hole H by the linear grinding members 6.

Here, the first annular member 75 and the second annular member 80 are inserted into the hole H, so that a certain spacing between the axial line L of the tool body 5 and the peripheral wall surface of the hole H is maintained by the first annular member 75 and the second annular member 80, whereby the run-out range of the tool body 5 is regulated. That is, in the case where the run-out on the front side of the tool body 5 occurs due to the rotation of the tool body 5, the first annular member 75 and the second annular member 80 come into contact with the peripheral wall surface of the hole H, thereby regulating the range of the run-out. As a result, the run-out of the polishing tool 2 is reduced, whereby a decrease in the accuracy of processing can be reduced. Furthermore, since the run-out of the tool body 5 is reduced, the workpiece W can be prevented from being damaged by a contact of the grinding member holder 7 or the shank 3 with the workpiece W. Furthermore, the shank 3 can be prevented from being bent or broken due to the run-out.

In the present embodiment, the first annular member 75 and the second annular member 80 are attached to the grinding member holder 7 and the shank 3, respectively, in a state of being movable in the direction of the axial line L and rotatable about the axial line L. Accordingly, when the first annular member 75 and the second annular member 80 come into contact with the peripheral wall surface of the hole H, the annular members 75 and 80 move independently of the grinding member holder 7 and the shank 3, respectively, and thus, the rotation of the polishing tool 2 can be prevented from being inhibited. That is, the first annular member 75 plays the role of a sliding bearing to support the grinding member holder 7 in the hole H, and the second annular member 80 plays the role of a sliding bearing to support the shank 3 in the hole H, whereby the run-out of the tool body 5 is reduced. Furthermore, since the annular members 75 and 80 move independently of the grinding member holder 7, when the annular members 75 and 80 come into contact with the peripheral wall surface of the hole H, the movement of the tool body 5 in the direction of the axial line L can be prevented from being inhibited.

Furthermore, in the present embodiment, the movement range of the annular members 75 and 80 in the direction of the axial line L is regulated, and therefore, although the annular members 75 and 80 are movable in the direction of the axial line L, the annular members 75 and 80 can be prevented from moving toward the linear grinding member 6 side and interfering with the linear grinding members 6 during processing operation. Furthermore, the annular members 75 and 80 can be prevented from moving toward the second shank 72 side and coming out of the hole H during processing operation.

In the present embodiment, the polishing tool 2 is connected to the first shank 71 with the threads, and the first shank 71 is connected to the second shank 72 with the threads, and therefore, the polishing tool 2, the first shank 71, and the second shank 72 can be easily detached from each other. Hence, in the case where the linear grinding members 6 are worn out by repeating polishing, the polishing tool 2 can be easily replaced with a new one. Furthermore, a plurality of first shanks 71 and second shanks 72 having different lengths can be easily used in combination to connect to each other in accordance with the depth of the hole H.

Furthermore, in the present embodiment, the second shank through hole 89 of the second shank 72, the first shank through hole 84 of the first shank 71, and the holder through hole 18 of the grinding member holder 7 communicate with each other, and therefore, even when the opening of the hole H is blocked by the insertion of the annular members 75 and 80 into the hole H during processing, machining oil and air can be supplied into the hole H via the second shank through hole 89, the first shank through hole 84, and the holder through hole 18.

Modification of Embodiment 6

In the rotating tool 1E of the present embodiment, the configuration of the connecting part 24 of the polishing tool 2 and the first shank 71 may be a configuration using the connecting screw 33, as is the case with the connecting part 24 of the polishing tool 2 and the shank 3 in Embodiment 2. Furthermore, the configuration of the connecting part 90 of the first shank 71 and the second shank 72 may be a configuration using the connecting screw 33, as is the case with the connecting part 24 of the polishing tool 2 and the shank 3 in Embodiment 2.

In the present embodiment, the shank 3 includes two shanks 3, namely, the first shank 71 and the second shank 72, but, may include three or more shanks. In this case, an annular member is preferably provided as the flange part 4 in the rear end of the two shanks connected in the forward and backward directions.

In the embodiment above, the connecting recess 22 including a female thread is formed on the first shank 71 side, and the tool-side threaded part 12 to be screwed into the female thread is formed on the grinding member holder 7 side. However, a connecting recess including a female thread may be formed on the grinding member holder 7 side, and a threaded part to be screwed into a female thread may be formed on the first shank 71 side. In this case, a configuration may be adopted in which a fitted part having a small diameter is provided on the first shank 71 side, so that the first annular member 75 is held on the first shank 71 side.

In the embodiment above, the second connecting recess 87 including a female thread is formed on the second shank 72 side, and the shank-side threaded part 79 to be screwed into the female thread is formed on the first shank 71 side. However, a connecting recess including a female thread may be formed on the first shank 71 side, and a threaded part to be screwed into a female thread may be formed on the second shank 72 side. In this case, a configuration may be adopted in which a fitted part having a small diameter is provided on the second shank 72 side, so that the second annular member 80 is held on the second shank 72 side.

Furthermore, in the embodiment above, the second shank through hole 89 is provided in the second shank 72, the first shank through hole 84 is provided in the first shank 71, and the holder through hole 18 is provided in the grinding member holder 7. However, if a decrease in the rigidity of the shank 3 is caused by the through holes 84 and 89, the through holes 18, 84, and 89 may be omitted.

Embodiment 7

Figure 14A:
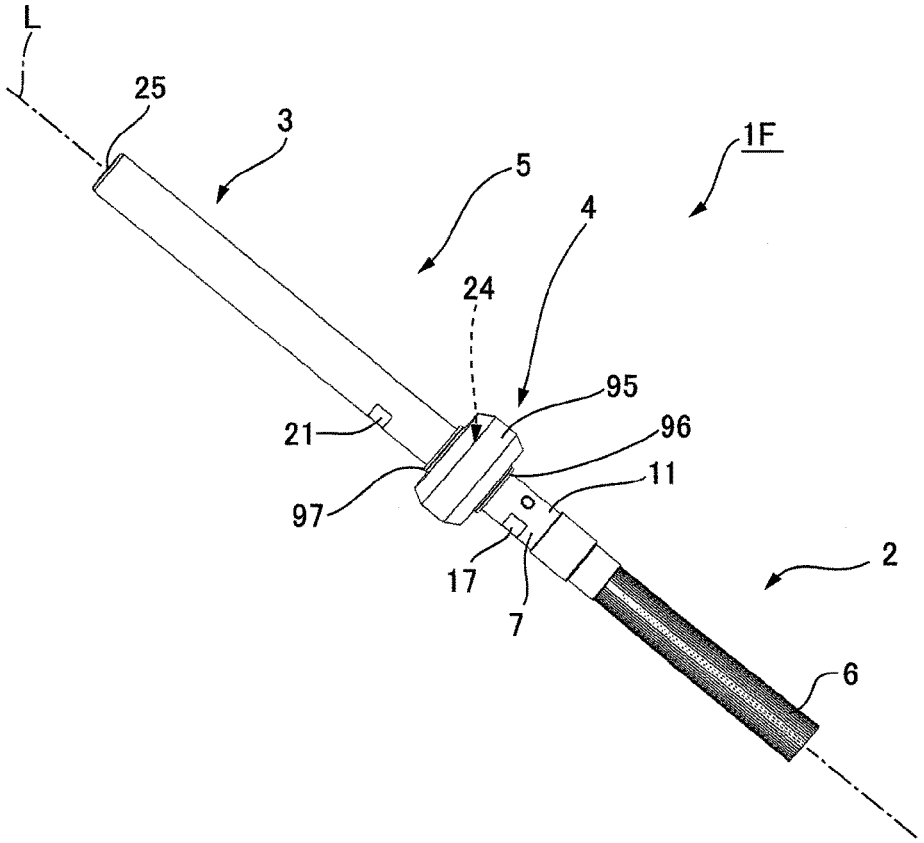
FIG. 14 is a perspective view and a cross-sectional view of a rotating tool of Embodiment 7.
Figure 14B:
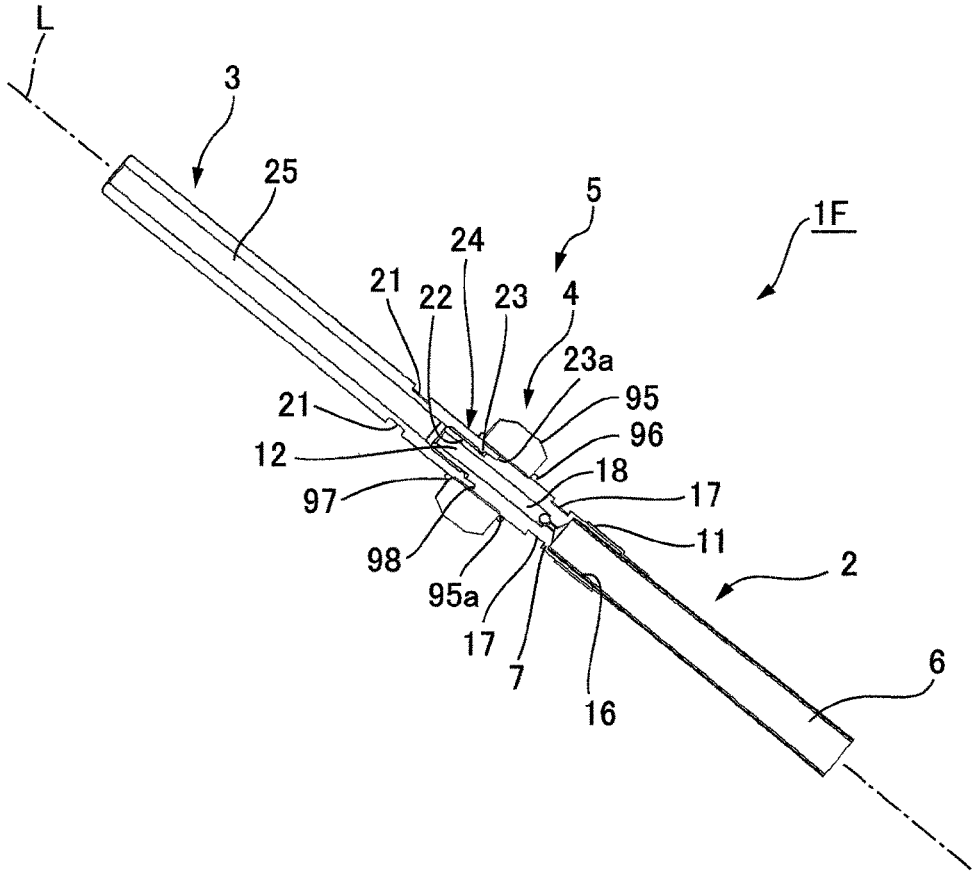
Figure 15:
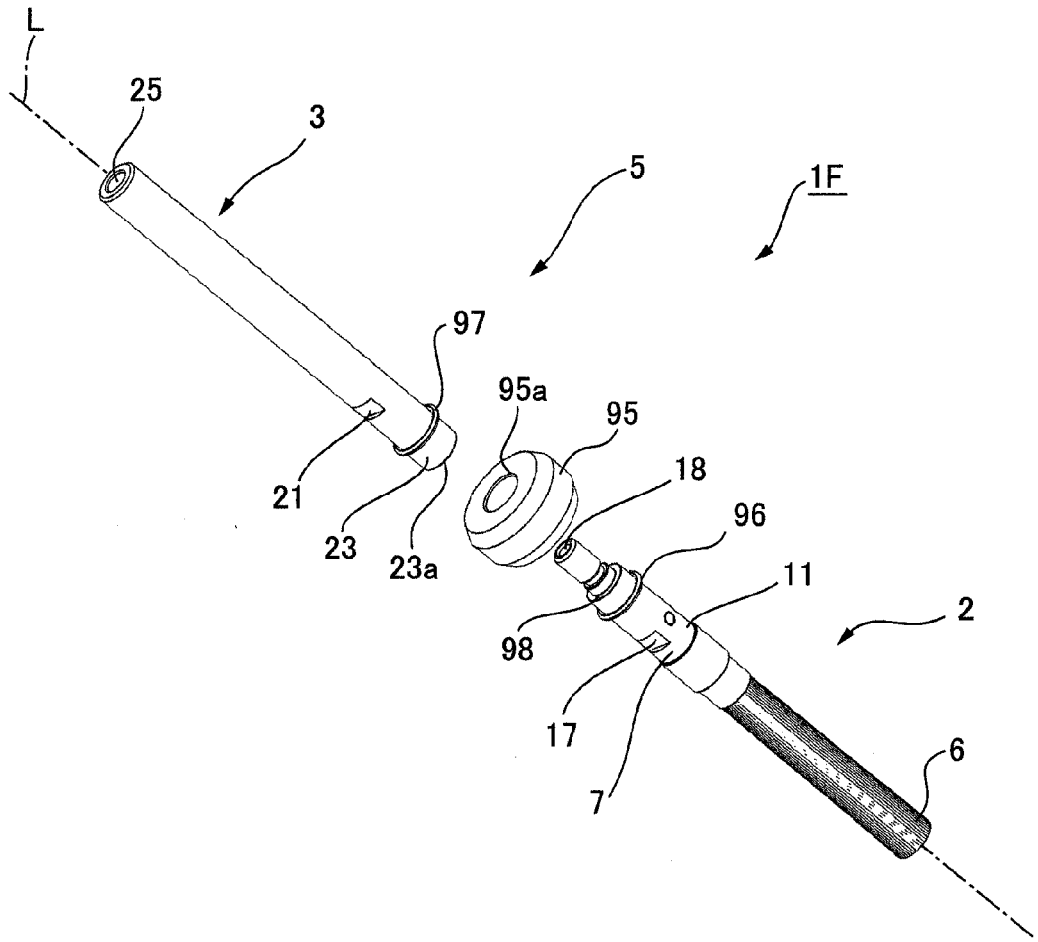
FIG. 15 is an exploded perspective view of the rotating tool illustrated in FIG. 14.

FIG. 14(*a*) is a perspective view of a rotating tool of the present embodiment, and FIG. 14(*b*) is a cross-sectional view of the rotating tool of the present embodiment, including the axial line L of the rotating tool. FIG. 15 is an exploded perspective view of the rotating tool illustrated in FIG. 14. Note that a rotating tool 1F of the present embodiment has the same configuration as that of the rotating tool 1 of Embodiment 1, and therefore, common reference signs are given to common constituents, and descriptions thereof are omitted.

As illustrated in FIG. 14(*a*), the rotating tool 1F of the present embodiment includes the polishing tool 2 and the shank 3 which are coaxially connected in the direction of the axial line L, and the flange part 4 provided over the grinding member holder 7 and the shank 3. That is, the polishing tool 2 and the shank 3 constitute the tool body 5, and the flange part 4 is provided at some point in the tool body 5 in the direction of the axial line L. The flange part 4 is an annular member 95 coaxially attached to the connecting part 24 of the polishing tool 2 and the shank 3. In the rotating tool 1F, a first O-ring 96 is attached to the front side of the annular member 95 and a second O-ring 97 is attached to the rear side of the annular member 95 so that the annular member 95 is sandwiched between the first O-ring 96 and the second O-ring 97 in the direction of the axial line L.

The polishing tool 2 includes the plurality of linear grinding members 6, and the grinding member holder 7 holding the rear ends of the plurality of linear grinding members 6. The grinding member holder 7 has a cylindrical shape, and as illustrated in FIG. 14(*b*), includes: the grinding member holding part 11 holding the linear grinding members 6; and the tool-side threaded part 12 having a diameter smaller than that of the grinding member holding part 11, in this order from the front to the rear. The rear ends of the plurality of linear grinding members 6 are inserted in a bundle into the grinding member holding recess 16 of the grinding member holding part 11, and fixed by an adhesive. Between the grinding member holding part 11 and the tool-side threaded part 12, a stage 98 having an annular end surface facing backward is formed. The grinding member holder 7 includes the holder through hole 18 penetrating in the direction of the axial line L.

The shank 3 is made of metal and has a cylindrical external shape. The outer diameter of the shank 3 is equal to the outside dimension of the grinding member holding part 11 of the grinding member holder 7. At the center of the front end surface of the shank 3, the circular connecting recess 22 recessed in the direction of the axial line L is formed. In the inner circumferential surface of the annular wall 23 surrounding the connecting recess 22, a female thread into which the tool-side threaded part 12 is screwed is formed. Furthermore, the shank 3 includes the shank through hole 25 penetrating in the direction of the axial line L. The front end opening of the shank through hole 25 is formed in the bottom of the connecting recess 22. The shank 3 may also be made of carbon fiber reinforced plastics.

Here, the annular member 95 has the same configuration as that of the annular member 8 of the rotating tool 1 of Embodiment 1, but, the inner diameter of a center hole 95*a* of the annular member 95 is larger than the inner diameter of the center hole 8*a* of the annular member 8 of Embodiment 1, and the shank 3 and the grinding member holding part 11 of the grinding member holder 7 can be inserted into the center hole 95*a*. Thus, the annular member 95 is held by the connecting part 24 of the polishing tool 2 and the shank 3 in a state of being movable in the direction of the axial line L and rotatable about the axial line L.

(Assembly of Rotating Tool)

When the rotating tool 1F of the present embodiment is assembled, the first O-ring 96 is inserted into the grinding member holder 7 of the polishing tool 2 from the rear. Thereafter, the rear end of the grinding member holder 7 is inserted into the center hole 95*a* of the annular member 95 so that the annular member 95 is partially held by the grinding member holding part 11 of the grinding member holder 7. Meanwhile, the second O-ring 97 is inserted into the shank 3 from the front, and, in this state, the tool-side threaded part 12 of the polishing tool 2 is screwed into the connecting recess 22 of the shank 3. The screwing of the threaded part into the connecting recess 22 is performed by engaging a tool such as a spanner in the cut-out portions 17 of the grinding member holder 7 and the cut-out portions 21 of the shank 3.

The shank 3 is connected to the grinding member holder 7, so that the annular member 95 is attached to the shank 3 and the grinding member holder 7 in a state that the movement of the annular member 95 in the forward and backward directions along the axial line L is regulated in the range between the first O-ring 96 and the second O-ring 97. That is, when the annular member 95 moves forward, the annular member 95 comes into contact with the first O-ring 96, whereby the forward movement of the annular member 95 is regulated, whereas when the annular member 95 moves backward, the annular member 95 comes into contact with the second O-ring 97, whereby the backward movement of the annular member 95 is regulated. Furthermore, when the shank 3 is connected to the grinding member holder 7, the shank through hole 25 of the shank 3 communicates with the holder through hole 18 of the grinding member holder 7.

(Processing Method)

When the inner circumferential surface of a hole H formed in the workpiece W is polished using the rotating tool 1F of the present embodiment, the polishing tool 2 and the annular member 95 are inserted into the hole H, as is the case illustrated in FIG. 3. Thereafter, the tool body 5 is rotationally driven to polish the bottom of the hole H by the linear grinding members 6.

Also in the present embodiment, the annular member 95 is inserted into the hole H, so that a certain spacing between the axial line L of the tool body 5 and the peripheral wall surface of the hole H is maintained by the annular member 95, whereby the range of the run-out of the tool body 5 is regulated. Therefore, also in the present embodiment, the same effects as in Embodiment 1 can be achieved.

Furthermore, in the present embodiment, a position to attach the first O-ring 96 and a position to attach the second O-ring 97 each can be moved in the direction of the axial line L. Accordingly, the position of the annular member 95 can be adjusted in accordance with the depth of the hole H. Furthermore, the movement range of the annular member 95 in the direction of the axial line L can be adjusted.

Note that both the first O-ring 96 and the second O-ring 97 are inserted into the grinding member holder 7 so that the annular member 95 is positioned between the first O-ring 96 and the second O-ring 97, whereby the annular member 95 can be held by the grinding member holder 7. Furthermore, both the first O-ring 96 and the second O-ring 97 are inserted into the shank 3 so that the annular member 95 is positioned between the first O-ring 96 and the second O-ring 97, whereby the annular member 95 can be held also by the shank 3.

Furthermore, in the rotating tool 1F of the present embodiment, the configuration of the connecting part 24 of the polishing tool 2 and the shank 3 may be a configuration using the connecting screw 33, as is the case with the connecting part 24 of the polishing tool 2 and the shank 3 in Embodiment 2.

Embodiment 8

Figure 16A:
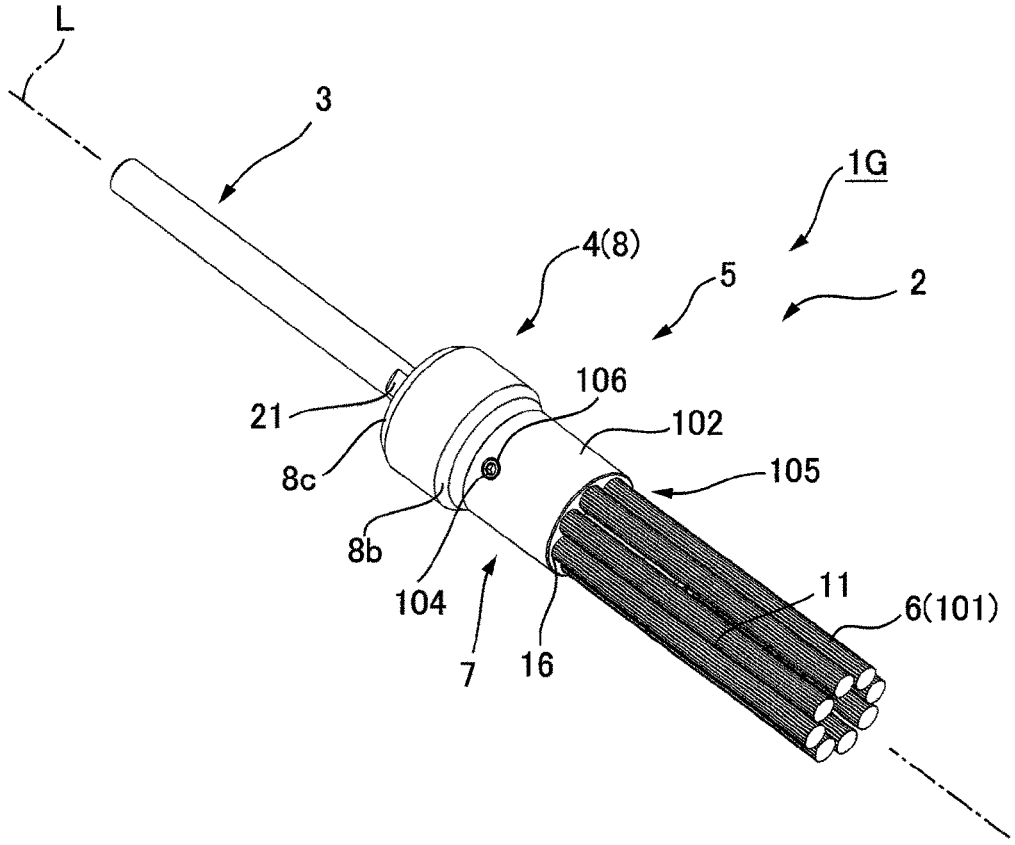
FIG. 16 is a perspective view and a cross-sectional view of a rotating tool of Embodiment 8.
Figure 16B:
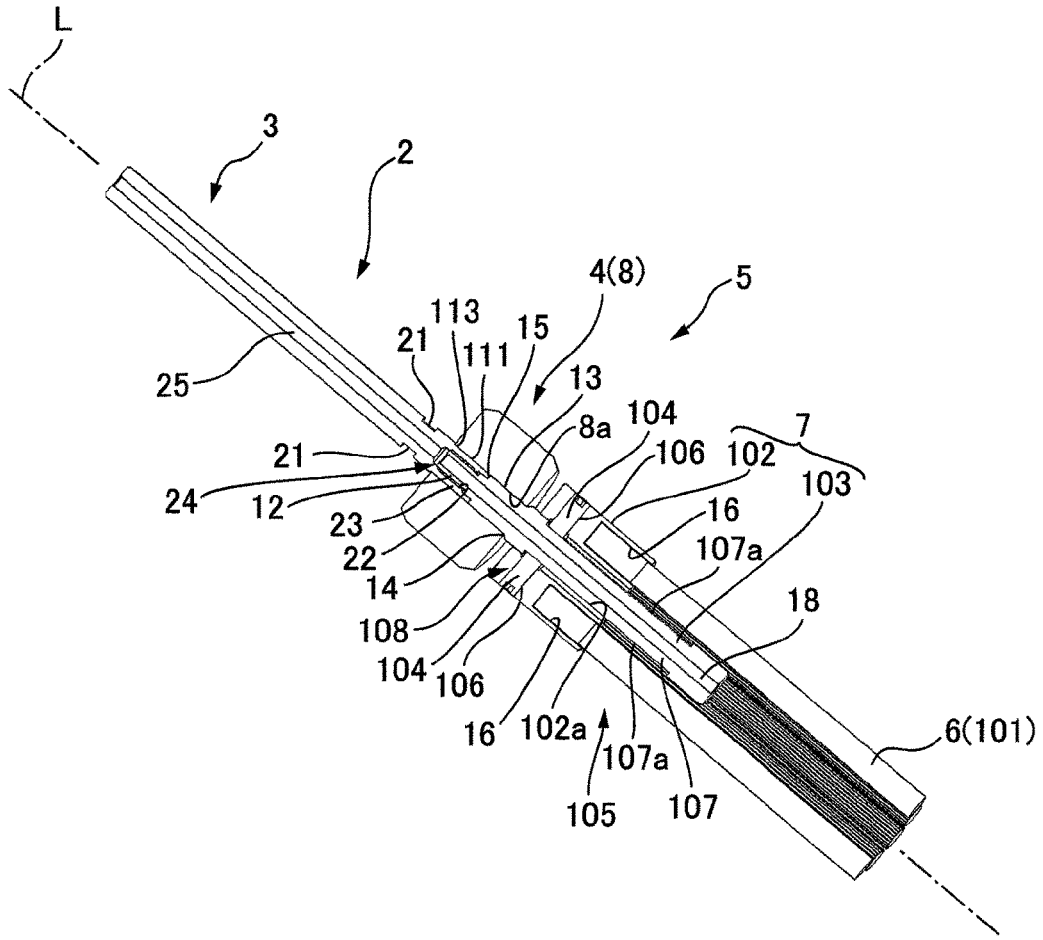
Figure 17:
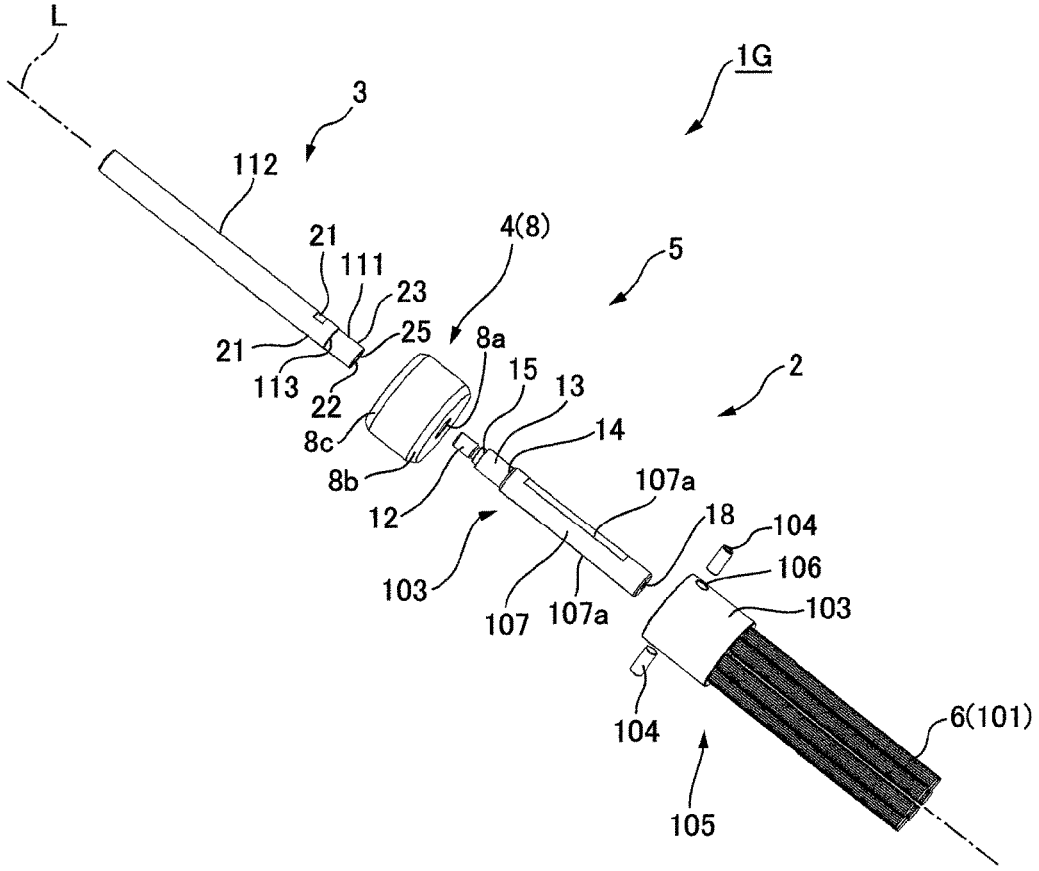
FIG. 17 is an exploded perspective view of the rotating tool illustrated in FIG. 16.

FIG. 16(*a*) is a perspective view of a rotating tool of the present embodiment, and FIG. 16(*b*) is a cross-sectional view of the rotating tool of the present embodiment, including the axial line L of the rotating tool. FIG. 17 is an exploded perspective view of the rotating tool illustrated in FIG. 16. A rotating tool 1G of the present embodiment differs from the rotating tool 1 of Embodiment 1 in the configuration of the front end surface of the shank 3 and the configuration of the grinding member holder 7. Note that the rotating tool 1G of the present embodiment has the same configuration as that of the rotating tool 1 of Embodiment 1, and therefore, common reference signs are given to common constituents, and descriptions thereof are omitted.

As illustrated in FIG. 16(*a*), the rotating tool 1G includes the polishing tool 2 and the shank 3 which are coaxially connected in the direction of the axial line L, and the flange part 4. The polishing tool 2 and the shank 3 constitute the tool body 5. The flange part 4 is provided at some point in the tool body 5 in the direction of the axial line L (rotation center axial line). The flange part 4 is the annular member 8 which is a component separate from the tool body 5.

The polishing tool 2 includes a plurality of grinding member bundles 101 each formed of a circular bundle of the plurality of linear grinding members (grinding members) 6. Furthermore, the polishing tool 2 includes the grinding member holder 7 holding the rear ends of the plurality of grinding member bundles 101. As illustrated in FIG. 16(*b*), the grinding member holder 7 includes: an annular holder body part 102 to hold the rear ends of the grinding member bundles 101; a bar-shaped part 103 penetrating the holder body part 102 and slidably supporting the holder body part 102 in the direction of the axial line L (rotation center axial line); and two set screws 104 to fix the holder body part 102 to the bar-shaped part 103. The shank 3 is connected to the rear end of the bar-shaped part 103, and the shank 3 coaxially extends together with the bar-shaped part 103.

The holder body part 102 and the bar-shaped part 103 are made of metal or resin. In the front end surface of the holder body part 102, a plurality of circular grinding member holding recesses 16 recessed in the direction of the axial line L is formed. The grinding member holding recesses 16 are annularly arranged at equiangular intervals. The rear end of each of the grinding member bundles 101 is inserted into the corresponding one of the grinding member holding recesses 16, and fixed by an adhesive. With this configuration, the grinding member bundles 101 protrude forward from the holder body part 102 in a state of being annularly arranged. The holder body part 102 and the grinding member bundles 101 constitute a cup-shaped polishing brush 105.

Furthermore, two threaded holes 106 are formed in the outer circumferential surface of the holder body part 102. The two threaded holes 106 are provided on opposite sides of the axial line L. Each of the threaded holes 106 penetrates in the radial direction perpendicular to the axial line L to communicate with a center hole 102*a* of the holder body part 102.

As illustrated in FIG. 17, the bar-shaped part 103 includes an insertion part 107 on the front side which is inserted into the center hole 102*a* of the holder body part 102 to coaxially support the holder body part 102. Two flat surfaces 107*a* extending in the direction of the axial line L are formed in the outer circumferential surface of the insertion part 107. The two flat surfaces 107*a* are provided on opposite sides of the axial line L. Each of the flat surfaces 107*a* extends in parallel to the axial line L.

Furthermore, the bar-shaped part 103 includes the tool-side threaded part 12 in the rear end. The tool-side threaded part 12 is a connecting part on the polishing tool 2 side to connect the polishing tool 2 to the shank 3. The tool-side threaded part 12 has a cylindrical shape, and a male thread is formed in the outer circumferential surface of the tool-side threaded part 12.

The fitted 13 is formed between the insertion part 107 and the tool-side threaded part 12. The outer diameter of the fitted part 13 is smaller than the outside dimension of the insertion part 107. The outer diameter of the tool-side threaded part 12 is smaller than the outer diameter of the fitted part 13. Thus, the first stage (first movement-regulation part) 14 including the first annular end surface facing backward is formed between the insertion part 107 and the fitted part 13, and the second stage 15 including the second annular end surface facing backward is formed between the fitted part 13 and the tool-side threaded part 12. Furthermore, the bar-shaped part 103 includes the holder through hole 18 penetrating in the direction of the axial line L.

In the assembly of the polishing tool 2, first, the insertion part 107 of the bar-shaped part 103 is inserted into the center hole 102*a* of the holder body part 102. Next, the holder body part 102 is slid along the bar-shaped part 103 so as to be disposed at a desired position in the direction of the axial line L. Thereafter, the set screws 104 are screwed into the threaded holes 106 of the holder body part 102, and as illustrated in FIG. 16(*b*), the ends (tips) on the inner circumference side of the set screws 104 are brought into contact with the flat surface 107*a* of the bar-shaped part 103. With this configuration, the holder body part 102 is fixed to the bar-shaped part 103. Here, the threaded holes 106 of the holder body part 102, the set screws 104, and the flat surface 107*a* of the bar-shaped part 103 constitute a fixing mechanism 108 configured to attachably and detachably fix the holder body part 102 to the bar-shaped part 103.

The shank 3 is made of metal or resin. The shank 3 includes a shank-side fitted part 111 in the front end which has an outer diameter equal to that of the fitted part 13 of the grinding member holder 7. A shank body part 112 is arranged at the rear of the shank-side fitted part 111 in the shank 3 and has the same outer diameter as that of the insertion part 107 of the grinding member holder 7. In the outer circumferential surface on the front side of the shank body part 112, a pair of the cut-out portions 21 cut from the outer circumference side is formed on both sides across the axial line L. Each of the cut-out portions 21 in a pair has a cut-out surface parallel to the axial line L.

At the center of the front end surface of the shank 3 (the front end surface of the shank-side fitted part 111), the circular connecting recess 22 recessed in the direction of the axial line L is formed as illustrated in FIG. 16(*b*). In the inner circumferential surface of the annular wall 23 surrounding the connecting recess 22, a female thread into which the tool-side threaded part 12 is screwed is formed. The connecting recess 22 is a connecting part on the shank 3 side to connect the shank 3 to the polishing tool 2, and constitutes the connecting part 24 of the polishing tool 2 and the shank 3, together with the tool-side threaded part 12 of the polishing tool 2. Accordingly, when the tool-side threaded part 12 of the bar-shaped part 103 of the grinding member holder 7 is screwed into the connecting recess 22, the polishing tool 2 is connected to the shank 3. The shank 3 includes the shank through hole 25 penetrating in the direction of the axial line L. The front end opening of the shank through hole 25 is formed in the bottom of the connecting recess 22.

The annular member 8 is made of resin, rubber, or metal. The annular member 8 is supported by the polishing tool 2 in a state that the fitted part 13 of the grinding member holder 7 and the shank-side fitted part 111 of the shank 3 are inserted into the center hole 8*a* of the annular member 8. The outer diameter of the annular member 8 is larger than the outer diameter of the holder body part 102.

The inner diameter of the center hole 8*a* of the annular member 8 is larger than the outer diameters of the fitted part 13 and the shank-side fitted part 111, and smaller than the outer diameters of the insertion part 107 and the shank body part 112. The length of the annular member 8 in the direction of the axial line L is shorter than the total of the length of the fitted part 13 in the direction of the axial line L and the length of the shank-side fitted part 111 in the direction of the axial line L. Hence, the annular member 8 is rotatable relative to the polishing tool 2 in a state of being fitted to the fitted part 13 and the shank-side fitted part 111. Furthermore, the annular member 8 is movable relative to the polishing tool 2 in the direction of the axial line L in a state of being fitted to the fitted part 13 and shank-side fitted part 111.

In the outer circumferential edge of the front end surface of the annular member 8, the first tapered surface 8*b* widening backward toward the outer circumference side is formed. In the outer circumferential edge of the rear end surface of the annular member 8, the second tapered surface 8*c* widening forward toward the outer circumference side is formed. The annular member 8 has a shape having symmetry with respect to a virtual plane perpendicular to the axial line L at the center of the annular member 8 in the direction of the axial line L.

In the assembly of the rotating tool 1G, the rear end of the bar-shaped part 103 of the grinding member holder 7 is inserted into the center hole 8*a* of the annular member 8 so that the annular member 8 is held by the fitted part 13. Thereafter, the tool-side threaded part 12 of the polishing tool 2 is screwed into the connecting recess 22 of the shank 3 so as to bring the front end surface of the annular wall 23 of the connecting recess 22 into contact with the second stage 15 between the fitted part 13 and the tool-side threaded part 12. With this configuration, the annular member 8 is held by the fitted part 13 and the shank-side fitted part 111. The screwing of the tool-side threaded part 12 into the connecting recess 22 is performed by engaging a tool such as a spanner in the cut-out portions 21 formed in the shank 3.

The grinding member holder 7 is connected to the shank 3 to constitute the tool body 5, so that the annular member 8 is supported by the tool body 5 in a state that the movement of the annular member 8 in the direction of the axial line L is regulated in the range of the fitted part 13 and the shank-side fitted part 111. That is, when the annular member 8 moves forward, the annular member 8 comes into contact with the first stage 14 (the first movement-regulation part) between the fitted part 13 and the insertion part 107, whereby the forward movement of the annular member 8 is regulated, whereas when the annular member 8 moves backward, the annular member 8 comes into contact with a stage 113 (a second movement-regulation part) between the shank body part 112 and the shank-side fitted part 111 in the shank 3, whereby the backward movement of the annular member 8 is regulated. Furthermore, when the shank 3 is connected to the grinding member holder 7, the shank through hole 25 of the shank 3 communicates with the holder through hole 18 of the grinding member holder 7 (the bar-shaped part 103).

The rotating tool 1G of the present embodiment can bring about the same operational effects as the rotating tool 1 of Embodiment 1 does. The rotating tool 1G of the present embodiment includes the plurality of grinding member bundles 101 annularly arranged around the axial line L, and is therefore more suitable for processing the hole H having a large inner diameter, compared with the rotating tool 1 of Embodiment 1.

Furthermore, in the present embodiment, the holder body part 102 to hold the grinding member bundles 101 is slidably supported in the direction of the axial line L by the bar-shaped part 103 of the grinding member holder 7. Therefore, when the set screws 104 are loosened to move the holder body part 102 along the insertion part 107, the front ends of the grinding member bundles 101 can be disposed at a desired position corresponding to the depth of the hole H to be processed. Furthermore, also in the case where the grinding member bundles 101 are worn out by processing operation, the set screws 104 are loosened to slide the holder body part 102 forward, whereby the front ends of the grinding member bundles 101 can be disposed at a desired position in the direction of the axial line L. Furthermore, when the grinding member bundles 101 are worn out, the holder body part 102 is pulled out from the bar-shaped part 103, and the holder body part 102 (the polishing brush 105) can be replaced with a new one. Thus, the bar-shaped part 103 can be reused.

Note that the configuration of Embodiment 2 may be adopted for the connecting part 24 of the polishing tool 2 and the shank 3.

Other Embodiments

In the embodiment above, the annular members included in the flange part 4 are movably attached relative to the grinding member holder 7 and the shank 3, but, may be immovably attached relative to the grinding member holder 7 and the shank 3. The annular members may be made immovable by, for example, equalizing the length of each of the annular members in the direction of the axial line L and the length of the fitted part in the direction of the axial line L. Furthermore, in the rotating tool 1F, the annular member may be made immovable by adjusting a spacing between the first O-ring and the second O-ring which are disposed on opposite sides of the annular member. Furthermore, the flange part 4 may be integrally formed with the grinding member holder 7, and the flange part 4 may be integrally formed with the shank 3. Also in the case of such configurations, when the run-out on the front side of a rotating tool occurs due to the rotation of the rotating tool, a certain spacing between the axial line L of the tool body 5 and the peripheral wall surface of the hole H is maintained by the flange part 4, whereby the range of the run-out of the rotating tool is regulated.

Note that, in the embodiment above, the tool body 5 configured by attachably and detachably connecting the shank 3 to the polishing tool 2 includes the flange part 4, but, a tool body 5 in which the polishing tool 2 is integral with the shank 3 may include the flange part 4.

Furthermore, in the embodiment above, the annular member included in the flange part 4 is attached to the tool body 5, but, the annular member may not be attached to the tool body 5. For example, an annular member having an outer diameter practically equal to the inner diameter of the hole H is prepared, and the outer circumferential surface of the annular member is applied as a fixed part to the peripheral wall surface of the hole H. Furthermore, the inner diameter of the center hole of the annular member is such that the tool body 5 can penetrate the hole. In this case, first, the annular member is inserted into the hole H of the workpiece W, and the annular member is fixed to the peripheral wall surface of the hole H by the fixed part. Thereafter, the tool body 5 is made to penetrate the center hole of the annular member, and rotate therein, whereby the inner circumferential surface of the hole H is processed.

Also with this configuration, a certain spacing between the axial line L of the tool body 5 and the peripheral wall surface of the hole H is maintained by the annular member, whereby the range of the run-out of the rotating tool can be regulated.

The invention claimed is:

1. A rotating tool configured to be inserted into a hole having a certain depth formed in a workpiece so as to process an inner circumferential surface of the hole, the rotating tool comprising:

a tool body; and a spacer to maintain a certain spacing between a rotation center axial line of the tool body and a peripheral wall surface of the hole, wherein the tool body includes a grinding member, a grinding member holder to hold a rear end of the grinding member, and a shank extending backward coaxially from the grinding member holder, the grinding member includes a plurality of linear grinding member, the grinding member holder holds rear ends of the plurality of linear grinding members in a bundle, and the spacer is attached to the tool body in a state of being movable in a direction of the rotation center axial line, and in a state of being rotatable about the rotation center axial line.

2. The rotating tool according to claim 1, wherein the spacer is shrinkable around the rotation center axial line in a radial direction.

3. The rotating tool according to claim 1, wherein the spacer has an outer diameter that increases gradually continuously or step by step toward a backside thereof.

4. The rotating tool according to claim 1, wherein the spacer includes a plurality of spacers disposed so as to be spaced from each other in a direction of the rotation center axial line.

5. The rotating tool according to claim 1, wherein the tool body and the shank includes a through hole that penetrates in a direction of the rotation center axial line.

6. The rotating tool according to claim 1, wherein the grinding member holder includes: an annular holder body part holding the rear end of the grinding member; a rod-shaped part penetrating the holder body part and slidably support the holder body part in a direction of the rotation center axial line; and a fixing mechanism fixing the holder body part to the rod-shaped part, and the shank extends backward from the rod-shaped part.

7. The rotating tool according to claim 1, wherein the grinding member includes a plurality of linear grinding members, and the grinding member holder holds rear ends of the plurality of linear grinding members in a bundle.

8. The rotating tool according to claim 1, wherein the grinding member holder and the grinding member constitute a polishing tool, and the polishing tool includes a connecting part configured to detachably connect the shank to the grinding member holder.

9. A rotating tool configured to be inserted into a hole having a certain depth formed in a workpiece so as to process an inner circumferential surface of the hole, the rotating tool comprising:

a tool body; and a spacer to maintain a certain spacing between a rotation center axial line of the tool body and a peripheral wall surface of the hole, wherein the tool body includes a grinding member, a grinding member holder to hold a rear end of the grinding member, and a shank extending backward coaxially from the grinding member holder, wherein the grinding member holder includes:

an annular holder body part holding the rear end of the grinding member;

a rod-shaped part penetrating the holder body part and slidably supporting the holder body part in a direction of the rotation center axial line; and a fixing mechanism fixing the holder body part to the rod-shaped part, and the shank extends backward from the rod-shaped part.

10. The rotating tool according to claim 9, wherein the grinding member includes a plurality of linear grinding members, and the grinding member holder holds rear ends of the plurality of linear grinding members in a bundle.

11. The rotating tool according to claim 9, wherein the spacer is attached to the tool body in a state of being movable in a direction of the rotation center axial line, and in a state of being rotatable about the rotation center axial line.

* * * * *